US012253282B2

(12) United States Patent
Serebrenykov et al.

(10) Patent No.: US 12,253,282 B2
(45) Date of Patent: Mar. 18, 2025

(54) DOUBLE-CIRCUIT ELECTRIC BOILER (VARIANTS)

(71) Applicants: Kostiantyn Leonidovych Serebrenykov, Kharkov (UA); Fedir Mashutovych Magasumov, Kharkov (UA)

(72) Inventors: Kostiantyn Leonidovych Serebrenykov, Kharkov (UA); Fedir Mashutovych Magasumov, Kharkov (UA)

( * ) Notice: Subject to any disclaimer, the term of this patent is extended or adjusted under 35 U.S.C. 154(b) by 923 days.

(21) Appl. No.: 17/421,539

(22) PCT Filed: Feb. 10, 2021

(86) PCT No.: PCT/UA2021/000013

§ 371 (c)(1),
(2) Date: Jul. 8, 2021

(87) PCT Pub. No.: WO2021/162670

PCT Pub. Date: Aug. 19, 2021

(65) Prior Publication Data

US 2022/0325916 A1 Oct. 13, 2022

(30) Foreign Application Priority Data

Feb. 13, 2020 (UA) ..... a 2020 00924

(51) Int. Cl.

| | |
|---|---|
| ***F24H 1/20*** | (2022.01) |
| ***F24H 1/52*** | (2022.01) |
| ***F24H 9/20*** | (2022.01) |

(52) U.S. Cl.
CPC ..... *F24H 1/202* (2013.01); *F24H 1/52* (2013.01); *F24H 9/2014* (2013.01)

(58) Field of Classification Search
None
See application file for complete search history.

(56) References Cited

U.S. PATENT DOCUMENTS 4,782,815 A * 11/1988 Friedman ..... F24H 1/43 122/18.4
4,993,402 A * 2/1991 Ripka ..... F24H 1/44 122/18.4

(Continued)

FOREIGN PATENT DOCUMENTS

CN 2572292 * 9/2003 ..... F24H 1/50

*Primary Examiner* — Thor S Campbell
(74) *Attorney, Agent, or Firm* — Nadya Reingand

(57) ABSTRACT

The invention is a double-circuit electric boiler for boiling a warming heat-carrying agent and a residential hot water. A hot water supply circuit first container and a second container with an electric heater for the heat-carrying agent of a warming circuit are arranged in a housing. Outer surfaces of inner walls of the warming circuit second container are in a contact with the water of the hot water supply circuit inside the first container. The electric heater for the heat-carrying agent is isolated by the second container walls from a contact with the water of the hot water supply circuit inside the first container. Both containers have separate inlet and outlet ducts and separate isolated temperature sensors. In a second embodiment of the boiler, an electric heater having heating areas isolated by the inner walls of the second container is further mounted in the first container.

16 Claims, 12 Drawing Sheets

(56) References Cited

U.S. PATENT DOCUMENTS

Figure 1:
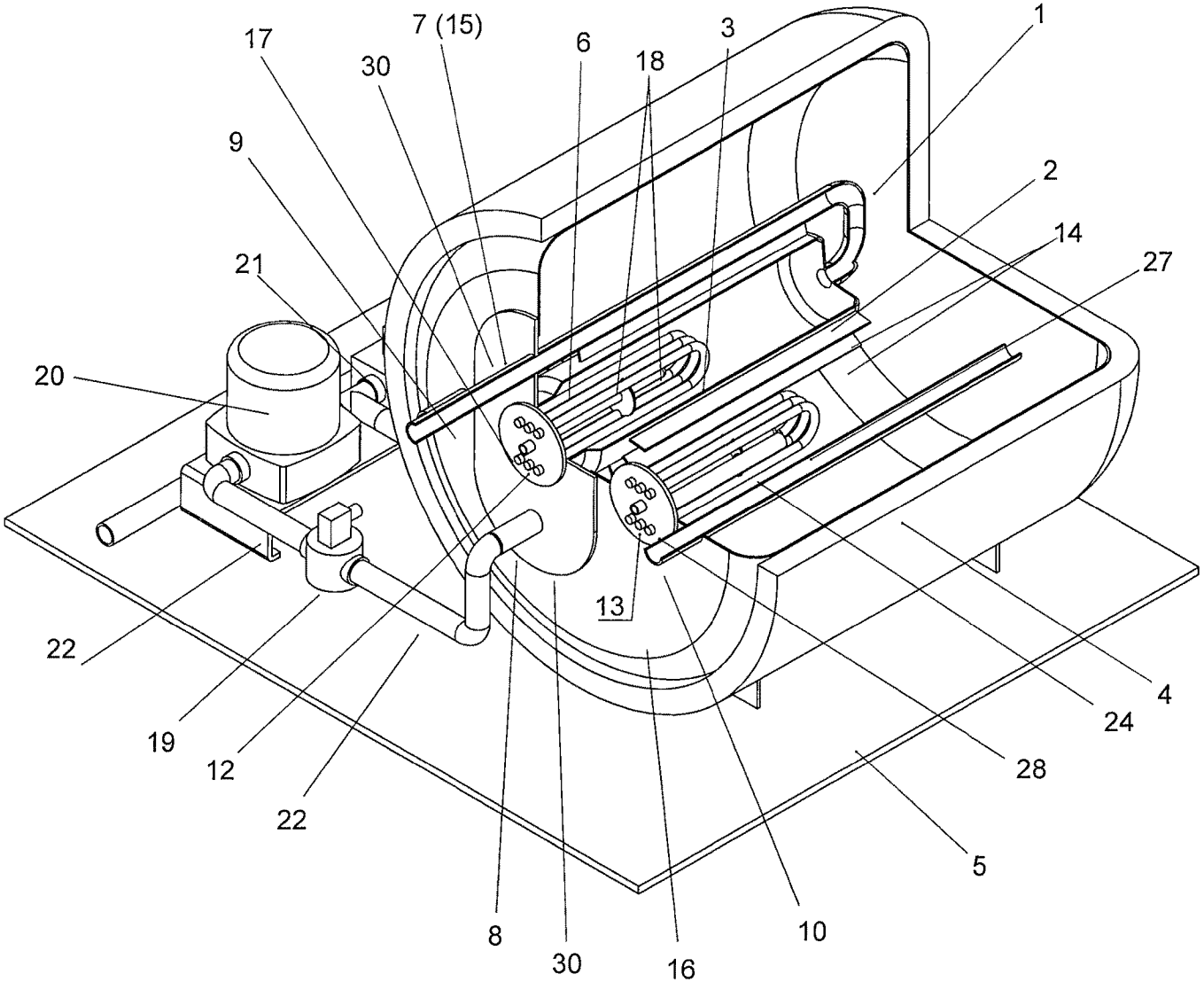

| | | | | |
|---|---|---|---|---|
| 5,076,494 | A * | 12/1991 | Ripka | F24H 1/48 237/19 |
| 6,152,086 | A * | 11/2000 | Brouwer | F24H 1/52 122/249 |
| 2008/0152331 | A1* | 6/2008 | Ryks | F24D 17/0031 392/490 |
| 2010/0282440 | A1* | 11/2010 | Trihey | F24H 8/00 165/104.19 |
| 2010/0310240 | A1* | 12/2010 | Yang | F24H 15/335 392/308 |
| 2020/0154940 | A1* | 5/2020 | Scotti | G05D 23/1904 |
| 2022/0404065 | A1* | 12/2022 | Barendrecht | F24H 1/181 |
| 2024/0117966 | A1* | 4/2024 | Kunjupillai | F24H 1/52 |

* cited by examiner

DOUBLE-CIRCUIT ELECTRIC BOILER (VARIANTS)

FIELD OF THE ART

The invention relates to an electric warming and water-heating equipment, and it is intended to simultaneously boil a heat-carrying agent for a room warming system and to boil a hot water mainly in domestic conditions and for domestic needs, but without limitation thereto, namely the proposed invention is a structure of a double-circuit electric boiler.

PRIOR ART

An electric water-heating double-circuit boiler is known, the boiler comprising a power supply system, control elements, a housing, electric heaters, a container (a heat-exchange chamber) for a water of a hot water supply circuit, a container (a heat-exchange chamber) for a heat-carrying agent of a warming circuit, an inlet and an outlet ducts (invention patent RU2123644, IPC F24H1/20, publ. on 20.12.1998 [1]). This structure is aimed at achievement of an efficiency increase due to a presence of an additional circuit of an intermediate heat-carrying agent, and due to peculiarities of a complex system for connecting the inlet and the outlet ducts within the circuit of the intermediate heat-carrying agent, and due to a presence of two additional heat-exchange chambers connected between each other within the circuit of the hot water, the chambers having openings, which provide the circuit of the intermediate heat-carrying agent in a certain way. Said invention is intended to provide large volumes of heat supply and hot water in industrial conditions. However, this structure is not intended for domestic use and does not allow to combine two electric devices (the warming one and the water heating-supply one) into a single device and, thus, to optimize and to reduce sizes and dimensions of the overall structure in order to save (reduce) an area for mounting and use the device in domestic conditions. Also, this invention does not allow to reduce heat losses by at least 10% and does not allow to achieve a possibility of a mutual heating of the heat-carrying agents within the containers of two circuits between each other if the electric heater does not operate within one of the circuits and, thus, it is not possible to achieve more stable overall operation of the double-circuit electric boiler.

A water heater or a boiler having an enhanced structure of a tank is known, the boiler comprising a housing having two containers arranged therein (a primary and a secondary heat exchangers), e.g., to heat a water of a hot water supply circuit and/or to heat a heat-carrying agent of a warming circuit, which have at least one heating element arranged therein, and the housing of the structure comprises an inlet and an outlet ducts (invention patent U.S. Pat. No. 5,666,943, IPC F24H1/20, publ. on 16.09.1997 [2]). In this structure of the water heater or boiler, the inner portion of the housing (tank) is divided into a primary and a secondary heat-exchange compartments (into two containers), wherein a liquid heat-carrying agent, e.g., a water to be heated, is arranged. The at least heating element is mounted within an inner cavity of the housing and within each of the two containers in such a way that this heating element within one (the lower one) container is isolated from the heat-carrying agent with the inner walls of its own shell (of a combustion chamber having walls, which transfer the heat), while within another one (within the upper container) the heated fire tubes of the heating element are in contact with the heat-carrying agent. It is mentioned that this invention achieves a very high efficiency (fuel-water 98% and higher) as well as due to reduction of components, the overall structure of the boiler is simplified, thereby allowing to reduce the dimensions and volume of a space for arranging and using the article. However, the structure of this invention does not imply a use of electric heaters and, thus, it is not intended to and does not allow to combine two electric devices (the warming one and the water heating-supply one) into a single device and, thus, to optimize and to reduce sizes and dimensions of the overall electric structure in order to save (reduce) an area for mounting and use the device in domestic conditions. Besides, said structure does not allow to achieve a possibility of a mutual heating of the heat-carrying agents within the containers of two circuits between each other if the electric heater does not operate within one of the circuits and, thus, such solution does not allow to achieve more stable overall operation of the double-circuit electric boiler.

There is a variety of qualitative various domestic electric appliances, which are made as separate boiling apparatuses, boilers, water heaters and others, on a market of modern warming and water heating devices. In most of cases, such devices act either as a heater for a heat-carrying agent for a warming system of a room or as a water heater (boiler) for supplying a hot water for domestic needs. Each of such appliances is a separated article and has its own dimensions. That is, such appliances are mounted separately, and each of them occupies a certain area and/or volume at locations of arrangement and use. Besides, each of such separate appliances comprises at least one own electric heating element that correspondingly requires a certain amount and power of electric energy. Thus, in order to simultaneously heat the heat-carrying agents for the warming system and to supply the hot water, two separate devices are used very often, thereby causing considerable electric energy costs and considerable loading on the electric system of the power supply system of a room, wherein the appliances are used.

An electric wall-mounted boiler "eloBLOCK" is known, the boiler comprising a power supply system, control elements, a housing with a container for a heat-carrying agent of a warming circuit mounted therein, the container has at least one electric heater of the heat-carrying agent of the warming circuit that is mounted therein, and said container comprises an inlet and an outlet ducts (Electrical wall hung boiler eloBLOCK, web-site Vaillant, 2019: Access mode: https://www.vaillant.info/customers/products/electrical-wall-hung-boiler-eloblock-768.html; access date: 23.12.2019 [3]; A textbook for mounting and technical maintenance of the electric wall-mounted boiler eloBLOCK VE . . . /14 RU, UA, web-site Vaillant.ua, 2019: Access mode: https://www.vaillantua/downloads/manuals/boilers/eloblock/2019/eloblock-0020264796-01-im-1480612.pdf; access date: 23.12.2019 [4]). This appliance has dimensions 740×410×310 (cm). Said boiler or variants thereof require a power supply of 6-28 kW (a three-phase mains) or 6-9 kW (a single-phase mains). A temperature of heating the heat-carrying agent is from 25 to 85° C. The electric wall-mounted boiler "eloBLOCK" is intended for heating and supplying the heat-carrying agent for the warming circuit of the room (without a function of heating the hot water for domestic needs).

The same manufacturer proposes, as possible "products associated with the electric wall-mounted boiler "eloBLOCK", an in-line electric heater comprising a power supply system, control elements, a housing with a heating unit mounted within it, the heating unit having at least one electric heater of a water of a hot water supply circuit, and an inlet and an outlet ducts (A textbook for using and mounting the in-line electric water heater electronicVED pro VED E . . . /8 B INT II, web-site Vaillant.ua, 2019: Access mode: https://www.vaillant.ua/downloads/manuals/ved/0020294302-01-1624607.pdf; access mode: 24.12.2019 [5]). Said in-line electric water heater has dimensions 481×240×100 (cm). The appliance or variants thereof require a power supply of 18-28 kW outputting the hot water of 35° C., 45° C., 55° C. up to 10 liters per 1 minute. It is understood that this appliance lacks a function of heating the heat-carrying agent for the warming system of a room.

Each of said "Vaillant" appliances performs its own function and it is understood that in order to simultaneously provide warming and heating of the water for domestic needs, it is required to mount and use both devices. Therefore, simultaneous use of two standalone said structures does not allow to combine two such electric devices (the warming one and the water heating-supply one) into a single device and, thus, to optimize and to reduce sizes and dimensions of the overall structure in order to save (reduce) an area for mounting and use the device in domestic conditions, as well as said technical solutions (the "Vaillant" appliances) do not allow to reduce the heat losses by at least 10%.

The closest one to each of the two proposed variants of the invention is a structure of "A warming and water boiling two-purpose electric water heater" that comprises a power supply system, control elements, a housing having inside a container for a water of a hot water supply circuit, wherein at least one electric water heater of the hot water supply circuit may be mounted inside the container, and a container for a heat-carrying agent of a warming circuit, wherein the at least one electric heater of the heat-carrying agent of the warming circuit is mounted inside the container, and each of said two containers comprises an inlet and an outlet ducts, and the container for the water of the hot water supply circuit comprises a heat insulation layer (Chinese utility model patent No. CN2572292Y, IPC F24H1/50, publ. on 10.09.2003 [6]). This known structure implies a presence of two containers, one for heating of the heat-carrying agent of the warming circuit, another one for heating the hot supply water. Both containers are vertically disposed in the single housing and a communication pipeline is mounted between them, a top portion of the pipeline comprises an opened container (a chamber) for water steam that naturally comes out along said pipeline upwards from the container of the warming circuit into the container of the hot water. This device is intended to simultaneously heat the heat-carrying agent of the warming circuit in the autonomous container with simultaneous heating of the hot water for domestic needs in another autonomous container, and such a heating occurs: due to a presence of two independent heaters in two autonomous containers, due to coupling of two walls of the vertically disposed containers, and due to a heat transfer from the communication pipeline and from the water steam that enters into the hot water container from the container of the warming circuit. The patent for this device states that it can be implemented by means of "an electric heat, natural gas, coal gas, liquid petroleum gas and other combustible gases", i.e. the description and drawings of this utility model are too general and are not intended to effectively combining two electric devices in a single structure with a possibility of its further effective use. A main purpose of this utility model is also to achieve a possibility of an automated heating of the hot water for domestic needs up to a certain temperature. However, this structure does not allow to combine two electric devices (the warming one and the water heating-supply one) into a single device and, thus, to optimize and to reduce sizes and dimensions of the overall structure in order to save (reduce) an area for mounting and use the device in domestic conditions, as well as it does not allow to reduce the heat losses by at least 10% and, as a consequence, it does not allow to increase the heat efficiency of the appliance by at least 10%.

Furthermore, said invention:

- does not allow to increase of the stability of heating the hot water in both circuits, and it does not allow to achieve the increase of the stability of supplying the heat-carrying agent into the warming system and to increase the stability of supplying the hot water for domestic use; does not allow to achieve a possibility of a mutual heating of the heat-carrying agents within the containers of two circuits between each other if the electric heater does not operate within one of the circuits and, thus, such solution does not allow to achieve more stable overall operation of the double-circuit electric boiler.

A technical task of the first embodiment of the invention is to create such a double-circuit electric boiler having a structure that, due to a set of all essential features, including novel features, could allow:

- to combine two electric devices (the warming one and the water heating-supply one) into a single device and thereby to optimize and to reduce sizes and dimensions of the overall structure in order to save (reduce) an area for mounting and use the device in domestic conditions,
- to reduce heat costs by at least 10% and, as a consequence, increase of the heat efficiency of the double-circuit electric boiler by at least 10%.

A technical task of the second embodiment of the invention is to create such a double-circuit electric boiler having a structure that, due to a set of all essential features, could allow: to combine two electric devices (the warming one and the water heating-supply one) into a single device and thereby to optimize and to reduce sizes and dimensions of the overall structure in order to save (reduce) an area for mounting and use the device in domestic conditions,

- to reduce heat costs by at least 10% and, as a consequence, increase of the heat efficiency of the double-circuit electric boiler by at least 10%,
- to increase the stability of heating the hot water in both circuits, and, as a consequence, to achieve the increase of the stability of supplying the heat-carrying agent into the warming system and increase of stability of supplying the hot water for domestic use;
- to achieve a possibility of the mutual heating of the heat-carrying agents in the containers of the both circuits between each other in case if the electric heater does not operate in one of the circuits and, as a consequence, to achieve a more stable overall operation of the double-circuit electric boiler.

SUMMARY OF THE INVENTION

According to the first embodiment of the invention, the stated task is resolved by that a double-circuit electric boiler comprises a power supply system, control elements, a housing 5 having inside a container 1 for a water of a hot water supply circuit and a container 2 for a heat-carrying agent of a warming circuit, wherein at least one electric heater 3 of the heat-carrying agent of the warming circuit is mounted inside the container, and each of said two containers 1, 2 comprises an inlet and an outlet ducts, and the container 1 for the water of the hot water supply circuit comprises a heat insulation layer 4.

What is novel is that in the first embodiment of the invention, the container 2 for the heat-carrying agent of the warming circuit, along with the at least one electric heater 3 of the heat-carrying agent of the warming circuit mounted in the container, is mounted and sealably and rigidly secured inside the container 1 for the water of the hot water supply circuit such that one of surfaces of the container 2 for the heat-carrying agent of the warming circuit is an outer wall 7 that is disposed and secured outside the container 1 for the water of the hot water supply circuit such that an inner surface 29 of the outer wall 7 is in contact with a mounting wall 16 of the container 1 of the hot water supply circuit, and an outer surface 30 of the outer wall 7 is disposed outside the container 1 of the hot water supply circuit. Therewith, the outer surfaces of inner walls 6 of the container 2 of the heat-carrying agent of the warming circuit that is disposed inside the container 1 for the water of the hot water supply circuit are in contact with the water of the hot water supply circuit inside the container 1 for the water of the hot water supply circuit. Furthermore, the at least one electric heater 3 of the heat-carrying agent of the warming circuit is fully isolated by the inner walls 6 of the container 2 of the warming circuit from a contact with the water of the hot water supply circuit that is disposed inside the container 1 of the hot water supply circuit. Therewith, the outlet duct 8 for drain of the heat-carrying agent from the container 2 of the warming circuit and the inlet duct 9 for supplying the heat-carrying agent into the container 2 of the warming circuit are sealably mounted and secured in technological openings of the outer wall 7 of the container 2 of the warming circuit, and their end openings are sealably coupled to the corresponding technological openings of the container 2 of the warming circuit inside the container 1 of the hot water supply circuit. And an outlet duct 10 for drain of the water from the container 1 of the hot water supply circuit and an inlet duct 11 for supplying the water into the container 1 of the hot water supply circuit are sealably mounted and secured in the corresponding technological openings of one of the walls of the container 1 of the hot water supply circuit such that their end openings are disposed inside the container 1 of the hot water supply circuit and areas of these outlet 10 and inlet 11 ducts, which are disposed inside the container 1 for the water of the hot water supply circuit, are fully isolated by the inner walls 6 of the container 2 of the heat-carrying agent of the warming circuit from a contact with the heat-carrying agent in the container 2 of the warming circuit. Furthermore, inside the container 2 of the warming circuit, there is mounted a temperature sensor 12 for the heat-carrying agent in the container 2 of the warming circuit such that this temperature sensor 12 is fully isolated by the inner walls 6 of the container 2 from a contact with the water in the container 1 of the hot water supply circuit. And inside the container 1 of the hot water supply circuit, there is mounted a temperature sensor 13 for the water in the container 1 such that this temperature sensor 13 is fully isolated by the inner walls 6 of the container 2 for the heat-carrying agent of the warming circuit from a contact with the heat-carrying agent in the container 2 of the warming circuit.

According to the second embodiment of the invention, the stated task is resolved by that a double-circuit electric boiler comprises a power supply system, control elements, a housing 5 having inside a container 1 for a water of a hot water supply circuit, the container has mounted therein at least one electric heater 27 for the water of the hot water supply circuit, and a container 2 for a heat-carrying agent of a warming circuit, wherein at least one electric heater 3 of the heat-carrying agent of the warming circuit is mounted inside the container, and each of said two containers 1, 2 comprises an inlet and an outlet ducts, and the container 1 for the water of the hot water supply circuit comprises a heat insulation layer 4.

What is novel is that in the second embodiment of the invention, the container 2 for the heat-carrying agent of the warming circuit, along with the at least one electric heater 3 of the heat-carrying agent of the warming circuit mounted in the container, is mounted and sealably and rigidly secured inside the container 1 for the water of the hot water supply circuit such that one of surfaces of the container 2 for the heat-carrying agent of the warming circuit is an outer wall 7 that is disposed and secured outside the container 1 for the water of the hot water supply circuit such that an inner surface 29 of the outer wall 7 is in contact with a mounting wall 16 of the container 1 of the hot water supply circuit, and an outer surface 30 of the outer wall 7 is disposed outside the container 1 of the hot water supply circuit. Therewith, the outer surfaces of inner walls 6 of the container 2 of the heat-carrying agent of the warming circuit that is disposed inside the container 1 for the water of the hot water supply circuit are in contact with the water of the hot water supply circuit inside the container 1 for the water of the hot water supply circuit. Furthermore, the at least one electric heater 3 of the heat-carrying agent of the warming circuit is fully isolated by the inner walls 6 of the container 2 of the warming circuit from a contact with the water of the hot water supply circuit that is disposed inside the container 1 of the hot water supply circuit. Therewith, the outlet duct 8 for drain of the heat-carrying agent from the container 2 of the warming circuit and the inlet duct 9 for supplying the heat-carrying agent into the container 2 of the warming circuit are sealably mounted and secured in technological openings of the outer wall 7 of the container 2 of the warming circuit, and their end openings are sealably coupled to the corresponding technological openings of the container 2 of the warming circuit inside the container 1 of the hot water supply circuit. And an outlet duct 10 for drain of the water from the container 1 of the hot water supply circuit and an inlet duct 11 for supplying the water into the container 1 of the hot water supply circuit are sealably mounted and secured in the corresponding technological openings of one of the walls of the container 1 of the hot water supply circuit such that their end openings are disposed inside the container 1 of the hot water supply circuit and areas of these outlet 10 and inlet 11 ducts, which are disposed inside the container 1 for the water of the hot water supply circuit, are fully isolated by the inner walls 6 of the container 2 of the heat-carrying agent of the warming circuit from a contact with the heat-carrying agent in the container 2 of the warming circuit. Furthermore, inside the container 2 of the warming circuit, there is mounted a temperature sensor 12 for the heat-carrying agent in the container 2 of the warming circuit such that this temperature sensor 12 is fully isolated by the inner walls 6 of the container 2 from a contact with the water in the container 1 of the hot water supply circuit. And inside the container 1 of the hot water supply circuit, there is mounted a temperature sensor 13 for the water in the container 1 such that this temperature sensor 13 is fully isolated by the inner walls 6 of the container 2 for the heat-carrying agent of the warming circuit from a contact with the heat-carrying agent in the container 2 of the warming circuit. Furthermore, the at least one electric heater 27 for the water of the hot water supply circuit is mounted and sealably secured in the corresponding technological opening of one of the walls of the container 1 for the water of the hot water supply circuit such that heating areas of the electric heater 27 are disposed inside the container 1 of the hot water supply circuit and are fully isolated by the inner walls 6 of the container 2 of the heat-carrying agent of the warming circuit from a contact with the heat-carrying agent in the container 2 of the warming circuit.

For some specific conditions and cases of use of each of the two structural embodiments of the invention, the proposed double-circuit electric boiler is characterized by the following features, which develop, specify the set of features of first and second independent claims.

Heat exchange ribs 14 are disposed on outer surfaces of the inner walls 6 of the container 2 of the heat-carrying agent of the warming circuit.

The outer wall 7 of the container 2 for the heat-carrying agent of the warming circuit is made in the form of a flange 15 that is a bottom of the container 2 for the heat-carrying agent of the warming circuit and that is connected to the inner walls 6 in the lower portion of the container 2 for the heat-carrying agent of the warming circuit, wherein the outer wall 7 in the form of the flange 15 is configured to be sealably secured to one of the walls of the container 1 of the hot water supply circuit.

The at least one electric heater 3 for the water-carrying agent of the warming circuit is mounted and fixed to the additional flange 17 that is, in turn, mounted and sealably secured in the corresponding technological opening of the outer wall 7 of the container 2 of the warming circuit or the electric heater 3 of the heat-carrying agent of the warming circuit is mounted and sealably secured in the corresponding technological opening of the outer wall 7 that is made in the form of the flange 15 that is the bottom of the container 2 for the heat-carrying agent of the warming circuit.

Each of the two embodiments of the double-circuit electric boiler comprises at least one additional electric heater 18 of the heat-carrying agent of the warming circuit that is mounted and sealably secured in the corresponding technological opening of the outer wall 7 of the container 2 for the heat-carrying agent of the warming circuit or is mounted and secured to the additional flange 17 that is, in turn, mounted and sealably secured in the corresponding technological opening of the outer wall 7 of the container 2 for the heat-carrying agent of the warming circuit or in the technological opening of the outer wall 7 that is made in the form of flange 15 that is the bottom of the container 2 for the heat-carrying agent of the warming circuit.

The temperature sensor 12 for the heat-carrying agent in the container 2 of the warming circuit is mounted and sealably secured to the additional flange 17.

Each of the two embodiments of the double-circuit electric boiler further comprises a flow monitoring sensor 19 for the heat-carrying agent of the warming circuit, a warming circuit pump 20 and a safety valve 21 of the warming circuit, which are mounted on an outlet pipe 22 of the warming circuit that is, in turn, coupled to the outlet duct 8 for drain of the heat-carrying agent from the container 2 of the warming circuit.

An expansion tank 23 is connected to the outlet pipe 22 of the warming circuit.

The boiler control elements are made in the form of an electronic system that comprises a controller 25, and this electronic system is assembled on a control panel 26 that is secured on a wall of the boiler housing 5, and a power supply and also the at least one electric heater 3 for the heat-carrying agent of the warming circuit, the temperature sensor 12 for the heat-carrying agent of the warming circuit, and the temperature sensor 13 for the water in the container 1 of the hot water supply circuit are coupled to the control panel 26.

The boiler control elements are made in the form of an electronic system that comprises a controller 25, and this electronic system is assembled on a control panel 26 that is secured on a wall of the boiler housing 5, the electric heater 3 for the heat-carrying agent of the warming circuit, a power supply and also the at least one electric heater 3 for the heat-carrying agent of the warming circuit, the temperature sensor 12 for the heat-carrying agent of the warming circuit, the temperature sensor 13 for the water in the container 1 of the hot water supply circuit, the flow control sensor 19 for the liquid heat-carrying agent of the warming circuit and the warming circuit pump 20 are coupled to the control panel 26.

The boiler control elements are made in the form of an electronic system that comprises a controller 25, and this electronic system is assembled on a control panel 26 that is secured on a wall of the boiler housing 5, and a power supply and also the at least one electric heater 3 and the at least one additional electric heater 18 of the warming circuit for the heat-carrying agent of the warming circuit, the temperature sensor 12 for the heat-carrying agent of the warming circuit, the temperature sensor 13 for the water in the container 1 of the hot water supply circuit are coupled to the control panel 26.

The boiler control elements are made in the form of an electronic system that comprises a controller 25, and this electronic system is assembled on a control panel 26 that is secured on a wall of the boiler housing 5, the electric heater 3 for the heat-carrying agent of the warming circuit, a power supply and also the at least one electric heater 3 and the at least one additional electric heater 18 of the warming circuit for the heat-carrying agent of the warming circuit, the temperature sensor 12 for the heat-carrying agent of the warming circuit, the temperature sensor 13 for the water in the container 1 of the hot water supply circuit, the flow control sensor 19 for the liquid heat-carrying agent of the warming circuit and the warming circuit pump 20 are coupled to the control panel 26.

The at least one electric heater 27 for the water in the container 1 of the hot water supply circuit is mounted and secured to the flange 28 that is, in turn, mounted and sealably secured in the corresponding technological opening of one of the outer walls of the container 1 of the hot water supply circuit.

The temperature sensor 13 for the water in the container 1 of the hot water supply circuit is mounted and secured to the flange 28 of the electric heater 27 for the water in the container 1 of the hot water supply circuit.

The at least one electric heater 27 for the water in the container 1 of the hot water supply circuit is coupled to the control panel 26.

Inventive Step

The structure of each of the two embodiments of the double-circuit electric boiler allows to resolve the posed technical tasks. The set of all essential features of each of the proposed two embodiments of the boiler, including the novel essential features of each of the embodiments of the device, allows to provide achievement of a technical effect, when they are used.

Both embodiments of the double-circuit electric boiler are intended to simultaneously boil a heat-carrying agent for a room warming system and to boil a hot water mainly in domestic conditions and for domestic needs.

The main novel feature of the first embodiment of the invention lies in that the container 2 for the heat-carrying agent of the warming circuit (hereinafter referred to as the WC container 2) is mounted and sealably and rigidly secured inside the container 1 for the water of the hot water supply circuit (hereinafter referred to as the HWS container 1). Therewith, the at least ones electric heater 3 of the heat-carrying agent of the warming circuit is mounted inside the WC container 2. Both containers are hermetically sealed. Each of the containers 1 and 2 (examples are depicted in the drawings) has a flask-like cylindrical shape. In order the WC container 2 could be effectively mounted and hermetically secured inside the HWS container 1, the WC container 2 must have sizes and dimensions smaller than the HWS container 1. The WC container 2 that is made in the form of a cylindrical flask in the present example has "inner walls" 6 and the outer wall 7. The inner walls 6 in the present example are referred to cylindrical side surfaces and a top wall of the WC container 2, which are arranged inside the HWS container 1. The inner walls 6 are made of metal or metal alloys, which have a high heat conductivity (e.g., of a stainless steel, but without limitation thereto). In the preset example, the outer wall 7 is a lower wall (a bottom) of the WC container 2, the wall, with its one outer surface 30, is arranged outwardly of the WC container 2 and, thus, outwardly of the HWS container 1, and, with its inner surface 29, being arranged "inwardly" to the WC container 2 and, thus, "inwardly" to the HWS container 1. The WC container 2 is mounted inside the HWS container 1 in such a way that the outer surfaces of the inner walls 6 (which are inside the HWS container 1) are in a direct physical contact with the water of the hot water supply circuit inside the HWS container 1. The at least one electric heater 3 of the heat-carrying agent of the warming circuit is fully isolated by the inner walls 6 of the WC container 2 from a direct physical contact with the water of the hot water supply circuit that is disposed inside the HWS container 1. Each of the two containers 1 and 2 has an independent inlet duct and outlet duct and its own temperature sensor. The WC container 2 is filled with the heat-carrying agent for heating thereof and supplying the same to the warming circuit of the room warming system. The HWS container 1 is filled with the water for heating thereof and supplying the same to the hot water supply circuit for domestic needs.

The first embodiment of the structure of the boiler provides that the electric heater 3 heats the heat-carrying agent inside the WC container 2, e.g., up to 60° C., and this heat-carrying agent comes to the room warming system. In the process of heating the heat-carrying agent for the warming circuit, a partial heat transfer from the heat-carrying agent to the inner walls 6 inside the WC container 2 naturally occurs during a certain time. The temperature of the successive heating of the inner walls 6 from the heat-carrying agent having a temperature of 60° C. may achieve, e.g., about 55° C.-60° C. Due to the high heat conductivity of the inner walls 6 and due to the direct contact of the outer surfaces of the inner walls 6 with the water inside the HWS container 1, there occurs a successive heat transfer and heating of this water in the HWS container 1. Thus, under such structure and operation of the first embodiment of the proposed boiler, there appears an increase of the heat efficiency in the form of reduction of the heat costs in a medium operation condition by at least 10%.

In order to provide an illustrative example, a rough estimate of the heat efficiency of the double-circuit electric boiler is provided hereinafter, which may be used both for the first and for the second embodiments of the boiler.

Initial Data:

- Heating temperature for the water of the HWS circuit—65° C.;
- Heating temperature for the water of the WC circuit—65° C.;
- Geometrical sizes of the HWS container 1—Ø315 mm×600 mm;
- Geometrical sizes of the WC container 2—Ø70 mm×500 mm;
- Environmental air temperature −20° C.

The estimate of the efficiency of the double-circuit electric boiler comes to calculation of the heat losses from the device surfaces of the HWS container 1 and the WC container 2, when they are designed and disposed as two separate devices as compared to the proposed double-circuit electric boiler.

Let's calculate a heat flow through the cylindrical walls of each of the HWS container 1 and the WC container 2 by means of the formula:

$$Q=k_l\pi(t_1-t_2)\cdot l$$

where $k_l$—linear heat transfer coefficient, l—height of the cylindrical HWS container 1 and WC container 2 (*m*), $t_1$—temperature of the water in any of the HWS container 1 and the WC container 2; $t_2$—environmental air temperature.

Let's calculate the heat flow through a flat wall (e.g., through the upper surface of the cylindrical HWS container 1 and WC container 2) of each of the HWS container 1 and the WC container 2 by means of the formula:

$$Q=k\cdot F(t_1-t_2)$$

where k—heat transfer coefficient, F—surface are, $t_1$—temperature of the water in any of the HWS container 1 and the WC container 2; $t_2$—environmental air temperature.

Let's find the linear heat transfer coefficient through the cylindrical inner walls 6 of the WC container 2 by means of the formula:

$$k_l=\frac{1}{\frac{1}{\alpha_1\cdot d_1}+\frac{1}{2\lambda}\cdot\ln\cdot\frac{d_2}{d_1}+\frac{1}{\alpha_2\cdot d_2}}$$

where $\alpha_1$—heat emission coefficient from the water in the WC container 2 to the inner walls 6, $\alpha_2$—heat emission coefficient from the inner walls 6 of the WC container 2 to another environment—to the water in the HWS container 1, $\lambda$—heat conductivity coefficient of the inner walls 6; $d_1$—inner diameter of the WC container 2; $d_2$—outer diameter of the WC container 2; ln—natural logarithm.

Let's find the linear heat transfer coefficient through the flat wall (e.g., of the upper surface of the cylindrical HWS container 1 and WC container 2) by means of the formula:

$$k=\frac{1}{\frac{1}{\alpha_1}+\frac{d}{\lambda}+\frac{1}{\alpha_2}}$$

where d—wall thickness (m), where $\alpha_1$—heat emission coefficient from the water to the wall, $\alpha_2$—heat emission coefficient from the water to another environment, $\lambda$—heat conductivity coefficient of the wall.

For the sake of convenience, further calculations are provided in the Table 1.

TABLE 1

| Value | Designation | Unit of measurement | Calculation formula | Results: HWS container 1 | Results: WC container 2 |
|---|---|---|---|---|---|
| 1 Heat flow through the cylindrical wall | $Q_1$ | W | $Q = k_1 \cdot \pi(t_1 - t_2) \cdot 1$ | 231.2 | 47.7 |
| 2 Heat flow through the flat wall | $Q_F$ | W | $Q = k_F \cdot F(t_1 - t_2)$ | 21.2 | 1.15 |
| 3 Linear heat transfer coefficient | $k_1$ | $\frac{W}{m \cdot ° C.}$ | $k_1 = \frac{1}{\frac{1}{\alpha_1 \cdot d_1} + \frac{1}{2\lambda} \cdot \ln \cdot \frac{d_2}{d_1} + \frac{1}{\alpha_2 \cdot d_2}}$ | 2.72 | 0.675 |
| 4 Heat transfer coefficient | $k_F$ | $\frac{W}{m \cdot ° C.}$ | $k = \frac{1}{\frac{1}{\alpha_1} + \frac{d}{\lambda} + \frac{1}{\alpha_2}}$ | 6.67 | 6.67 |
| 5 Height of the container | l | m | Initial data | 0.6 | 0.5 |
| 6 Area of the upper surface of the container | F | $m^2$ | Initial data | 0.07065 | 0.00385 |

Calculation of the heat losses has been made without consideration of the effect from operation of the heat insulation layer 4, because these studies are aimed at defining a percentage of heat energy saving between the systems—when the HWS container 1 and the WC container 2 are disposed and operate independently and separately from each other, and when the WC container 2, according to the utility model, is disposed and operates inside the HWS container 1.

Heat losses of the HWS container 1—$Q_{HWS}1$=252.4 W (231.2 W+21.2 W);

Heat losses of the WC container 2—$Q_{HC}2$=48.85 W (47.7 W+1.15 W);

Overall heat losses of the HWS container 1 and the WC container 2—$Q_{HWS}1+Q_{HC}2$=252.4+48.85=301.25 W.

According to the utility model, when the WC container 2 is disposed inside the HWS container 1, the overall heat losses of these containers will constitute Qgeneral=$Q_{HWS}1-Q_{HC}2$=252.4 W. The overall heat losses are constituted only from the losses of the HWS container 1 without the losses of the WC container 2 that transfers all the heat to the water inside the HWS container 1 through the walls.

Thus, following from the calculations provided, in the described operational mode of the boiler, there are achieved a reduction of the heat losses of not less than by 10% and, as a consequence, an increase of the heat efficiency of the structure, namely:

Reduction of the heat losses/efficiency=(301.25−252.4)*100/301.25=16.21%.

Therefore, both embodiments of the invention achieve a technical effect in terms of reduction of the heat losses during operation of the boiler by at least 10% and, as a consequence, increase of the heat efficiency of the double-circuit electric boiler by at least 10%.

It is understood that the water heating process in the HWS container 1 is not occurred with a high rate, and 3-4 hours are required for such heating of the water in the HWS container 1 from the inner walls 6 of the WC container 2, e.g., having a volume of 50 liters, under the power of the electric heater 3 of the WC container 2 being, e.g., 6 kW, up to the temperature of, e.g., 60° C. However, it is known from the practice of use of the known devices for heating the water for domestic needs that in the most cases, the volume of consumption of the hot water for domestic needs in the most time is not large, and such consumption may be large usually either in the morning and/or in the evening time, when consumers, e.g., actively use the hot water for taking a shower. And in this embodiment of the invention, the unexpected effect of the boiler operation lies in that, e.g., at night and/or in the afternoon (when the large need in the hot flow water in the HWS circuit and in the HWS container), due to the continuous operation of the at least one electric heater 3 for the heat-carrying agent for the warming circuit in the WC container 2, the simultaneous continuous, gradual, but stable heating of the water in the HWS container 1 occurs from the inner walls 6 of the WC container 2. It is understood that certain heat losses take place in the room warming system continuously, and in order to maintain a certain required temperature in the warming circuit, the continuous operation of the electric heater 3 in the WC container 2 is required that occurs in fact. Therefore, due to the operation of only one electric heater 3 (that heats the heat-carrying agent of the warming circuit, and this heat-carrying agent heats the inner walls 6 of the WC container 2, and the inner walls 6 heat the water in the HWS container 1) additionally with achievement of the main technical effect, a significant saving of electric energy for heating the water is provided as compared to the known structures for heating the water, which operate as separate standalone devices. As it has been already mentioned, the heating of the required volume in the HWS container 1 occurs due to a relatively long time (several hours), the presence of a "still" water in the HWS container 1 and due to the continuous operation of the at least one electric heater 3 for the heat-carrying agent of the warming circuit in the WC container 2 with its heated inner walls 6 being in a continuous contact with the "still" water in the HWS container 1 (until this water is not used by consumers). Thus, in the known cases of use of two separate electric appliances in the domestic conditions (e.g., the electric boiler for the warming circuit and the flow water heater for heating the domestic hot water as mentioned in the analogues [3], [4], [5] of the present invention), the electric energy costs are always much more than during use of the structure of the claimed double-circuit electric boiler.

The unexpected effect lies in that during use of the claimed double-circuit electric boiler with the operation of one electric heater 3 for the heat-carrying agent (that "directly" heats the heat-carrying agent, e.g., the water in the warming circuit in the WC container 2 and additionally and indirectly through the inner walls 6 of the WC container 2 it heats the water in the HWS container 1) this entire water heating system inside the WC container 2 and the HWS container 1 naturally tries to "balance" itself in terms of the temperature value of the heat-carrying agents of the two warming circuits. That is, if the temperature t1 of the heat-carrying agent of, e.g., 60° C., is achieved and maintained in the warming circuit (and in the WC container 2), then the "still" water in the HWS container 1 is naturally heated due to the contact with the heated inner walls of the WC container 2. It is understood that these heated inner walls 6 at the beginning of the heating process do not have such temperature as the WC heat-carrying agent (60° C.), this temperature t2 is lower and, thus, the temperature t3 of the heated "still" water in the HWS container 1 is also lower than t1 and t2—e.g., on the basis of practical researches, this temperature t3, after several hours of "standing" of the water in the HWS container (4-5 hours depending on the volume of the HWS container 1 and power of the electric heater 3 for the WC heat-carrying agent), may reach 60° C. that is generally sufficient for the effective use of the entire volume of the heated water from the HWS container 1 in domestic conditions for several persons during, e.g., 2-3 hours in the evening or in the morning. When more long-term process of operation of the electric heater 3 for the WC heat-carrying agent and heating of the heat-carrying agent in the warming circuit (e.g., 6-7 hours) takes place, then the temperature t3 of the heated "still" water in the HWS container 1 also gradually reaches the same temperature as the temperature t1 of the WC heat-carrying agent. That is, the heat-carrying agent of the warming circuit and the water of the hot water supplying circuit are naturally balanced in terms of the temperature under the condition of: a presence of a stable environmental temperature within the room, where the claimed double-circuit electric boiler is used; a stable operation of the electric heater 3 for the heat-carrying agent in the WC container 2 and under the condition of a long-term "standing" of the water (e.g., 4-6 hours) in the HWS container 1 (the duration of heating of the "still" water also depends on the volume of the HWS container 1, on the power of the electric heater 3 and on "heat conductivity" properties of the inner walls 6 of the WC container 2). It is understood that for more rapid heating of the water in the HWS container 1, the power of the current operation of the electric heater 3 may be increased, but not so much as if it would be an additional separate device for heating the water for domestic needs. In the time period, when the water in the HWS container 1 is not consumed and is not circulated, and it is only gradually heated from the inner walls 6 of the WC container 2, in combination with the fact that the HWS container 1 has the heat insulation layer 4, the heat losses are reduced by more than 10% (according to the above-mentioned calculations, this value constitutes 16.21% without consideration of the heat insulation layer 4, and with the heat insulation layer the reduction of the heat losses by about 18-20% may be achieved). Thus, the increase of the heat efficiency of the double-circuit electric boiler by not less than 10% and more is achieved.

The original and non-standard technical solution within the structure of the first embodiment of the double-circuit electric boiler lies in that this embodiment of the structure may be used to heat the water during a "non-warming" period of the year, when the warming is not required within the room, and, thus, there is no need to heat the heat-carrying agent and to "feed" the same to the room warming system. During the "non-warming" period of the year, the following actions are performed to heat the hot water for the hot water supply circuit: forcibly blocking the access of the heat-carrying agent from the WC container 2 to the room warming circuit system, and, thus, this heat-carrying agent is heated by the at least one electric heater 3 only inside the WC container 2, and then the water in the HWS container 1 is heated from the inner walls 6 of the WC container 2, this heated water then is used by consumers for domestic needs. Of course, in this case of use of the boiler, heating of the water in the HWS container 1 may occur more rapidly, since: the electric heater 3 heats the heat-carrying agent inside the WC container 2 only, which has a small volume as compared to the entire volume of the room warming system; during the "non-warming" period, the temperature of the environmental air (where the boiler is disposed) is usually higher than during the "warming period", and, thus, heat costs are reduced, and the heat insulation layer 4 operates in a more effective way to maintain the temperature of the heated water in the HWS container 1.

Except for the simultaneous or separate heating of the heat-carrying agent for the room warming and for the heating of the water for domestic needs by means of a single device with achievement of the reduction of the heat costs and, at the same time, with minimum possible electric energy costs, a modern problem of mounting and use of such devices is a number of space for mounting and dimensions of these devices. A large number of modern domestic rooms has a small area and volume, and, thus, dimensions of any device to be mounted within a flat or in a house is a very important characteristic for consumers. The proposed first embodiment of the double-circuit electric boiler is intended to solve the problem of reduction of dimensions of the device for simultaneous warming and heating the domestic water. Due to the structural features of the WC container 2 with the at least one electric heater 3 mounted in combination with the structural features of the HWS container and due to fact that the WC container 2 is integrated (mounted and secured) inside the HWS container 1, it is allowed to combine two electric devices (the warming one and the water heating-supply one) into a single device and thereby to optimize and to reduce sizes and dimensions of the overall structure in order to save (reduce) an area for mounting and use the device in domestic conditions.

Due to the fact that the WC container 2 is integrated (mounted and secured) inside the HWS container 1, while the inner walls 6 of the WC container 2 transmit the heat from the heat-carrying agent (that is disposed in the WC container 2 and is heated by the at least one electric heater 3) to the water that is disposed inside the HWS container 1, and due to the presence and mutual arrangement and connection of all other structural elements of the first embodiment of the invention (which are stated as essential features), it is allowed to achieve, by means of the one double-circuit electric boiler, the simultaneous heating of the heat-carrying agent for the warming circuit and heating of the water for the hot water supply circuit, while reducing the heat costs by at least 10% and, as a consequence, increasing the heat efficiency of the double-circuit electric boiler by at least 10%.

Therefore, the set of essential features of the first embodiment of the invention, including its novel features, when it is used, allows to achieve the technical effect and to resolve the posed technical task that lies in creation of the double-circuit electric boiler for the simultaneous heating of the heat-carrying agent for the warming circuit and of the water for the hot water supply circuit with achievement of the reduction of dimensions, with achievement of the reduction of the heat costs and with the increase of the heat efficiency of the double-circuit electric boiler.

Novel features of the second embodiment of the invention also lie in that the WC container 2 is mounted and sealably and rigidly secured inside the HWS container 1. Therewith, the at least ones electric heater 3 of the heat-carrying agent of the warming circuit is also mounted inside the WC container 2. Both containers are hermetically sealed. Each of the containers (in the examples depicted in the figures) may have a flask-like cylindrical shape. In order to provide an effective mounting and sealed securing of the WC container 2 inside the HWS container 1, the WC container 2 has smaller sizes and dimensions than the HWS container 1. The WC container 2 that is made in the form of the cylindrical flask in the examples has the "inner walls" 6 and the outer wall 7 that is a lower wall (bottom) of the WC container 2 in the depicted examples of the WC container 2, the wall, with its one outer surface 30, is arranged outwardly of the WC container 2 and, thus, outwardly of the HWS container 1, and, with its inner surface 29, being arranged "inwardly" to the WC container 2 and, thus, "inwardly" to the HWS container 1. The WC container 2 is mounted inside the HWS container 1 in such a way that the outer surfaces of the inner walls 6 (which are inside the HWS container 1) are in a direct contact with the water of the hot water supply circuit inside the HWS container 1. The at least one electric heater 3 of the heat-carrying agent of the warming circuit is fully isolated by the inner walls 6 of the WC container 2 from a direct contact with the water of the hot water supply circuit that is disposed inside the HWS container 1. Each of the two containers 1 and 2 has an independent inlet duct and outlet duct and its own temperature sensor. The WC container 2 is filled with the heat-carrying agent for heating thereof and supplying the same to the warming circuit of the room warming system. The HWS container 1 is filled with the water for heating thereof and supplying the same to the hot water supply circuit for domestic needs.

In contrast to the first embodiment of the invention, the second embodiment of the structure of the boiler provides that the at least one electric heater 27 for the water of the hot water supply circuit is mounted inside the HWS container 1. What is novel is that this at least one electric heater 27 for the water of the hot water supply circuit is mounted and sealably secured in the corresponding technological opening of one of the walls of the HWS container 1 (e.g., in the mounting wall 16) such that heating areas of the electric heater 27 are disposed inside the container 1 of the hot water supply circuit and are fully isolated by the inner walls 6 of the container 2 of the heat-carrying agent of the warming circuit from a contact with the heat-carrying agent in the WC container 2. The electric heater 27 for the water of the hot water supply circuit is intended to heat the water in the HWS container 1 at the same time heating this water from the inner walls 6 of the WC container 2. It is understood that additional electric energy costs are required for the operation of the electric heater 27 in the HWS container 1 (as compared to the first embodiment of the invention, wherein only the electric heater 3 operates in the WC container 2), however, the unexpected effect provided by the simultaneous operation of the electric heater 3 in the WC container 2 and the electric heater 27 in the HWS container 1 lies in that in the process of the simultaneous heating of the heat-carrying agent in the WC container 2 and of the water in the HWS container 1, a relatively rapid mutual heat exchange occurs between these two heat-carrying agents through the inner walls 6 of the WC container 2. That is, not only the heat-carrying agent from the WC container 2 transfers the heat through the inner walls 6 to the water in the HWS container 1 (as it takes place in the first embodiment of the invention), but the water (that is heated by the electric heater 27 inside the HWS container 1) partially transfers its heat also through the inner walls 6 of the WC container 2 to the heat-carrying agent inside the WC container 2. Substantially, according to the second embodiment of the invention, two separated heat-carrying agents are disposed within a single enclosed space and, at the same time, are heated by two independent electric heaters 3 and 27, and in this process, all this water heating system inside the WC container 2 and the HWS container 1 naturally tries to "balance" itself in terms of the temperature value of the heat-carrying agents of the two warming circuits. And such "balancing" takes place in a much more rapid fashion than in the first embodiment of the invention (approximately by 2.5 times, when the volume of the HWS container 1 is 50 liters, and when the electric heater 3=6 kW and the electric heater 27=2 kW as compared to the first embodiment of the invention without the electric heater 27). Thus, when the heating rate of both liquids is increased in both containers 1 and 2, the heat losses are reduced significantly as in the first embodiment of the invention. The below-stated calculations (Table 1 and calculations made on the basis of the data from the Table 1) fully correspond to the results of the operation of the second embodiment of the boiler. That is, if (considering the calculations of the Table 1) the heat losses of the HWS container 1 ($Q_{HWS}1$) constitute 252.4 W, while the heat losses of the WC container 2 ($Q_{WC}2$) constitute 48.85 W, then the overall losses of the HWS container 1 and the WC container 2 will constitute 301.25 W. According to the second embodiment of the invention, the WC container 2 is disposed inside the HWS container 1, and, thus, the overall heat losses of these containers 1 and 2 will constitute $Qgeneral=Q_{HWS}1-Q_{HC}2=252.4$ W. The overall heat losses in the second embodiment (as in the first embodiment) are constituted only from the losses of the HWS container 1 without the losses of the WC container 2 that transfers all the heat to the water inside the HWS container 1 through the walls.

Thus, following from the calculations provided in the Table 1, in the described operational mode of the second embodiment of the boiler, there are achieved a reduction of the heat losses of not less than by 10% and, as a consequence, an increase of the heat efficiency of the structure, namely:

reduction of the heat losses/efficiency=(301.25−252.4)*100/301.25=16.21%.

Therefore, the second embodiment of the invention achieves a technical effect in terms of reduction of the heat losses during operation of the boiler by at least 10% and, as a consequence, increase of the heat efficiency of the double-circuit electric boiler by at least 10%.

Due to the presence of the independent temperature sensor 12 for the heat-carrying agent in the WC container 2 and the temperature sensor 13 for the water in the HWS container 1, due to the possibility of coupling these temperature sensors 12 and 13 and the electric heaters 3 and 27 to the control elements in the form of the controller 25 and the control panel 26, it is allowed to selectively control the heating of the heat-carrying agent in the WC container 2 and of the water in the HWS container 1 in time and with various power. That is, the consumer is enabled (automatically or manually) to select the optimal and required mode of the heating of both the heat-carrying agent for the warming and the water for the hot supplying. For example, in case if the consumer does not need to use the hot water for the domestic needs within a long time, he/she may completely turn off the electric heater 27, however, at the same time (during the "warming period" of time), the "still" water in the HWS container 1 will still have a rather high temperature (e.g., 50° C.) due to the heating from the inner walls 6 of the WC container 2 (in the same way as in case of operation of the first embodiment of the invention). In another case, e.g., when a rapid and maximum heating of the hot water in the HWS container 1 is required, the consumer may maximally load the electric heater 27 for a certain time, and the heater will rapidly "finish warming" of this water (that is in the preliminary heated state) up to the required temperature (e.g., 60° C.-65° C.). Therefore, due to the presence and operation of said structural elements, their arrangement and coupling to the control elements of the boiler, it is allowed to achieve a portion of the technical effect, namely, to increase the stability of heating the hot water in both circuits, and, as a consequence, to achieve the increase of the stability of supplying the heat-carrying agent into the warming system and to increase the stability of supplying the hot water for domestic use, and, at the same time, to increase the rate of heating the hot water in the hot water supply circuit for domestic use.

In the second embodiment of the invention, when the two independent electric heaters 3 and 27 and the two independent sensors 12 and 13 are present, it becomes unexpectedly possible to provide a certain "insurance" for the effective operation of the boiler in cases, when, e.g., one of the two heaters is out of service fully or partially, or is under repairing, or operates ineffectively for some reasons. That is, if any of the two electric heaters 3 or 27 no longer operates effectively and heats its own heat-carrying agent, then the consumer will be enabled to track this on the control panel 26 and to add up the power to the operating electric heater, if necessary. And, any of the two heaters continues to operate (with the power enhancement or without the enhancement) to heat its own heat environment that naturally transfers the heat to another environment through the inner walls 6 of the WC container 2. Such operation of the boiler may, during a certain time (e.g., during the repairing or replacement of one of the electric heaters), maintain a certain stable temperature both in the warming system (when the electric heater 27 heats the water in the HWS container 1 and, through the inner walls 6 of the WC container 2, it finishes heating of the heat-carrying agent in the WC container 2) and in the hot water supply system (when the electric heater 3 heats the heat-carrying agent in the WC container 2 and, through the inner walls 6 of the WC container 2, it finishes heating of the water in the HWS container 1). Therefore, due to the "integration" of the WC container 2 inside the HWS container 1, due to the possibility of the heat exchange between the two environments (the WC and the HWS circuit) inside the HWS container 1 through the inner walls 6 of the WC container 2, due to the independent operation of the electric heaters 3 and 27 and the sensors 12, 13, and due to the possibility of controlling the operation of the electric heaters 3 and 27, it is allowed to increase the stability of heating the hot water in both circuits, and, as a consequence, to achieve the increase of the stability of supplying the heat-carrying agent into the warming system and increase of stability of supplying the hot water for domestic use. Furthermore, it is allowed to achieve a possibility of the mutual heating of the heat-carrying agents in the containers 1 and 2 of the both circuits between each other in case if the electric heater (3 or 27) does not operate in one of the circuits and, as a consequence, to achieve a more stable overall operation of the double-circuit electric boiler.

The presence of the electric heater 27 in the HWS container 1 enables, during the "non-warming" period of the year, to provide a complete turning off of the electric heater 3 for the heat-carrying agent of the warming circuit, and to use only the electric heater 27 of the HWS container 1 to heat the hot water, thereby stabilizing the operation of the boiler and, at the same time, reducing the electric energy consumption. In another case, in order to provide more rapid heating of the water in the HWS container 1, it is possible to block the outlet duct 8 and to block access of the heat-carrying agent from the WC container 2 to the room warming system, and further (simultaneously with the operation of the electric heater 27 in the HWS container 1) to heat the heat-carrying agent, by the electric heater 3 of the WC container 2, in the WC container 2 that is "isolated" from the warming system, and then this heat-carrying agent, through the inner walls 6 of the WC container 2, will additionally heat the water in the HWS container 1 simultaneously with the electric heater 27 of the HWS container 1, thereby significantly increasing the rate of heating of the water in the HWS container 1 and stabilizing this process.

Due to the fact that in the second embodiment of the invention, the WC container 2 is integrated (mounted and secured) inside the HWS container 1, due to the presence of the independent electric heaters 27 and 3 in each of the containers 1 and 2, respectively, due to the fact that the inner walls 6 of the WC container 2 are mutual transmitters of the heat between the heat-carrying agents (disposed in the WC container 2 and is heated by the at least one electric heater 3) and the water (hat is disposed inside the HWS container 1), and due to the presence and mutual arrangement and connection of all other structural elements of the second embodiment of the invention (which are stated as essential features), it is allowed to achieve, by means of the one double-circuit electric boiler, the simultaneous heating of the heat-carrying agent for the warming circuit and heating of the water for the hot water supply circuit, and thereby:

- to combine two electric devices (the warming one and the water heating-supply one) into a single device and thereby to optimize and to reduce sizes and dimensions of the overall structure in order to save (reduce) an area for mounting and use the device in domestic conditions;
- to reduce heat costs by at least 10% and, as a consequence, increase of the heat efficiency of the double-circuit electric boiler by at least 10%,
- to increase the stability of heating the hot water in both circuits, and, as a consequence, to achieve the increase of the stability of supplying the heat-carrying agent into the warming system and increase of stability of supplying the hot water for domestic use;

to achieve a possibility of the mutual heating of the heat-carrying agents in the containers of the both circuits between each other in case if the electric heater does not operate in one of the circuits and, as a consequence, to achieve a more stable overall operation of the double-circuit electric boiler.

The achievement of the technical effect is enhanced by the fact that in separate design variants of each of the two embodiments of the structure, the heat exchange ribs 14 are disposed on the outer surfaces of the inner walls 6 of the WC container 2. Surfaces of the heat exchange ribs 14 are in a physical contact with the water inside the HWS container 1. The presence of the heat exchange ribs 14 on the outer surfaces of the inner walls 6 of the WC container 2 increase the area of surfaces of the WC container 2, which are elements for the heat exchange between the heat-carrying agent inside the WC container 2 and the water in the HWS container 1.

In order to confirm the efficiency of the presence and the operation of the heat exchange ribs 14 on the outer surfaces of the inner walls 6 in both embodiments of the boiler, there are further stated the calculations of the amount of the heat that is transferred: from the outer surfaces of the inner walls 6 of the WC container 2 without the heat exchange ribs 14; from the outer surfaces of the inner walls 6 of the WC container 2 with the heat exchange ribs 14.

The calculation of the amount of the heat transferred from the WC container 2 to the water inside the HWS container 1.

Let's calculate the heat transfer from the area of 1 $m^2$ (q, $W/m^2$) of the heated vertical surface of the inner wall 6 of the WC container 2, where the height of the wall is, e.g., 0.5 m, with the temperature $t_c$=65° C. (according to the same existing temperature achieved in the WC container 2) to the water inside the HWS container 1. The emissivity factor of the surface of the inner walls 6 of the WC container 2 is, e.g., $\varepsilon_c$=0.9.

Solution

The heat flow (q) per the area unit from the inner wall 6 of the WC container 2 to the water in the HWS container 1 is transferred by a convection heat exchange and emission:

$$q=q_c+q_b;\mathrm{W/m^2}$$

wherein:

$q_c$ is a heat flow that is transferred by the convection, $W/m^2$;

$q_b$ is a heat flow that is transferred by emission, $W/m^2$.

The heat flow that is transferred by the convection:

$$q_c=\alpha(t_w-t_l)\mathrm{W/m^2}$$

wherein:

α is a coefficient of heat transfer from the wall to the heat-carrying agent, $W/m^2*K$;

$t_w$ is a temperature of the wall, ° C.;

$t_l$ is a temperature of the heat-carrying agent, ° C.

The heat flow that is transferred by the emission:

$$q_b = C_0\varepsilon_c\left[\left(\frac{T_w}{100}\right)^4-\left(\frac{T_1}{100}\right)^4\right]_{W/m^2}$$

Physical properties of the water under $t_l$=35° C. (a arithmetic mean value between cold water 5° C. and the heated water 65° C.):

The heat conductivity coefficient—λ=0.622 W/m*K

Kinematic viscosity—$v=7.23*10^{-7}$ $m^2$/sec

Prandtl number for the heat-carrying agent (water)—$Pr_l$=4.83

The temperature of the wall—Under $t_w$=65° C.

Prandtl number for the wall—$Pr_w$=2.76

$$(Gr_1\cdot Pr_1)=\frac{g\beta(t_w-t_1)l^3}{v^2}\cdot Pr_1=\frac{9.8\cdot\frac{1}{293}\cdot(65-35)\cdot 0.5^3}{(7.23\cdot 10^{-6})^2}\cdot 4.83=1.1589\cdot 10^{10}$$

Wherein:

$Gr_l$ is a Grashof number;

g is a gravitational acceleration, g=9.81 $m/sec^2$;

l is a linear size of the heat exchange surface, m;

$t_w$ is a temperature of the wall, ° C.;

$t_l$ is a temperature of the heat-carrying agent, ° C.;

ν is a kinematic viscosity coefficient, $m^2$/sec;

β is a temperature coefficient of a volumetric expansion of the heat-carrying agent.

Since $(Gr_l\times Pr_l)>6\times 10^{10}$, mean coefficient α of the heat transfer is calculated according to the formula:

$$Nu=0.15(Gr_1\cdot Pr_1)^{0.33}\cdot\left(\frac{Pr_1}{Pr_w}\right)^{0.25}=0.15(1.1589\cdot 10^{10})^{0.33}\cdot\left(\frac{4.83}{2.76}\right)^{0.25}=361.4$$

$$\alpha=\frac{Nu\cdot\lambda}{l}=\frac{361.4\cdot 0.622}{0.5}=449.6\ \mathrm{W/m^2}$$

Wherein:

Nu is a Nusselt number.

α is a coefficient of heat transfer from the wall to the heat-carrying agent, $W/m^2*K$ Let's calculate the convection heat transfer:

$$q_c=449.6(65°\ \mathrm{C.}-35°\ \mathrm{C.})=13488\ \mathrm{W/m^2}$$

Let's calculate a radial (radiated) heat transfer:

$$q_b=5.67\cdot 0.9\left[\left(\frac{338}{100}\right)^4-\left(\frac{308}{100}\right)^4\right]=206.8_{W/m^2}$$

Let's calculate the overall heat transfer from the area of 1 $m^2$ of the surface of the inner wall 6 of the WC container 2:

$$q=13488+206.8=13695\ \mathrm{W/m^2}$$

Let's assume that the overall area of the outer surfaces of the WC container 2 (which are disposed inside the HWS container 1 and contact with the water of this HWS container 1) without the heat exchange ribs 14 is 0.11 $m^2$.

The heating power will be Q=0.11 $m^2\times 13695$ $W/m^2$=1506 W

The corresponding equivalent overall area of the outer surfaces (which are disposed inside the HWS container 1 and contact with the water of this HWS container 1) of the same WC container 2 with the heat exchange ribs 14 will be, e.g., about 0.26 $m^2$.

The heating power will be Q=0.26 $m^2\times 13695$ $W/m^2$=3560 W

Difference of the heating powers: %=(3560 W−1506 W)×100/3560=57%

Therefore, in case, when the outer surfaces of the WC container 2, which are disposed inside the HWS container 1 and contact with the water of this HWS container 1, comprise the heat exchange ribs 14, the power of the heat transfer from such outer surfaces and with the heat exchange ribs 14 of the WC container 2 is about 57% greater than in the WC container 2 without the heat exchange ribs 14 (with consideration of the calculation parameters stated initially). Thus, it is possible to believe that when the heat transfer power is increased, the rate of heating of the water in the HWS container 1 will increase naturally and significantly. And, in the same way, due to the presence of the heat exchange ribs 14, the heat exchange rate between the two containers is increased in the second embodiment of the invention, when the HWS container 1 comprises the electric heater 27.

Following from the above-mentioned, when the heat exchange ribs 14 are present, said heat exchange processes between the heat-carrying agent inside the WC container 2 and the water in the HWS container 1 occur in a more rapid and efficient manner than in case when the outer surfaces of the inner walls 6 of the WC container 2 are made flush without the heat exchange ribs 14. Therefore, the presence and arrangement of the heat exchange ribs 14 enable to enhance the achievement of the technical effects:

- in the first embodiment of the invention, in terms of increase of the heat efficiency of the double-circuit electric boiler (due to the accelerated heat emission from the heat-carrying agent from the WC container 2 to the water in the HWS container 1);
- in the second embodiment of the invention (due to the accelerated heat emission from the heat-carrying agent from the WC container 2 to the water in the HWS container 1) in terms of:—increase of the heat efficiency of the double-circuit electric boiler; achievement of the mutual heating of the heat-carrying agents in the containers of both circuits between each other, if the electric heater does not operate in one of the circuits, increase of the heating stability of the hot water in both circuits, and increase of stability of supplying the heat-carrying agent to the warming system and increase of stability of supplying the hot water for the domestic use.

In the process of practical test and operation of both embodiments of the boiler, an unexpected positive effect has been revealed, which lies in use of the WC container 2 as a heating element for the water in the HWS container 1. During a rather long usage time of the WC container 2 as a heating element, it has been revealed that the outer surface of the inner walls 6 (which are constantly in the direct contact with the water in the HWS container 1), these walls 6 (their entire area) are not "cluttered" with salts and "scale" as it usually takes place in most of the known electric heating elements in similar systems and devices. That is, consumers do not have to replace the WC container 2 as a heating element after a certain time or to clean its walls 6 from "scales" and salts, which are accumulated on its walls. Reasons for absence of "cluttering" with salts and "scale" on the outer surfaces of the inner walls 6 are as follows:

- a small initial and current temperature difference between the WC container 2 and the water in the HWS container 1;
- a significantly greater (as compared to traditional electric heating elements) outer area of the inner walls 6 of the WC container 2.

Such effect of the operation of the structure facilitates achievement of the technical effect of the utility model in terms of achievement of a more stable overall operation of the double-circuit electric boiler.

In separate design variants of both embodiments of the invention, the outer wall 7 of the WC container 2 may be made in the form of the flange 15 that is the bottom of the container 2 for the heat-carrying agent of the warming circuit or in the form of the additional flange 17, each of them being intended for mounting thereon of the at least one electric heater 3 and for further hermetical secure of the outer wall 7 (in the form of the flange 15 or in the form of the additional flange 17) to one of the walls of the HWS container 1 during the mounting (inserting and securing) of the WC container 2 inside the HWS container 1. Also, said two flanges 15 and 17 may be used together for mounting and securing the WC container 2 inside the HWS container 1, wherein the electric heater 3 in such case is attached to the additional flange 17. Such solutions allow to improve and diversify the achievement of the technical effect of the both embodiments of the invention in terms of combining the two electric appliances (the warming one and the water heating and water supplying one) into a single device and optimizing and reducing the sizes and dimensions of the overall structure that, in turn, allows to achieve saving (reduction) of the space for mounting and using the device in the domestic conditions.

Furthermore, designing of the outer wall 7 of the WC container 2 with various configurations also allows to mount, on this wall 7, both one electric heater 3 (minimum power) and several additional electric heaters 18 (increased power) in order to increase the heating rate and to increase the volume of the heat-carrying agent in the WC container 2, to increase the volume of the heat-carrying agent for the room warming system and to increase the power and the operation rate of the boiler in general. The increased number of the additional electric heaters 18 requires more rigid structure of the outer wall 7 of the WC container 2 to which the electric heaters 3 and the additional electric heaters 18 are secured, and, thus, in such cases, the outer wall 7 of the WC container 2 is designed as a combination of said flange 15 and additional flange 17 (FIG. 1, 4, 6, 9, 10). Therefore, the possibility of designing the outer wall 7 of the WC container 2 in various configurations allows to manufacture the boiler structures of various volumes and power depending on conditions of the room, where it is mounted and used.

Also, when designing the outer wall 7 in the form of the additional flange 17 in the structure of each of the two embodiments of the boiler, it is allowed to mount and sealably secure the temperature sensor 12 for the heat-carrying agent in the WC container 2 to this additional flange 17.

The designing of the outer wall 7 of the WC container 2 in various configurations (in the form of the flange 15 or in the form of the additional flange 17, or in the form of the combination of the flanges 15 and 17) and the possibility of mounting various number of electric heaters in the WC container 2 by securing the electric heaters 3 and 18 to various configurations of the outer wall 7 allows to diversify and improve the achievement of the technical effect of both embodiments of the invention in terms of combining two electric appliances (the warming one and the water heating and supplying one) having various powers and volume into a single device and to optimize and reduce sizes and dimensions of the overall structure that, in turn, allows to achieve saving (reduction) of the space for mounting and using the device in domestic conditions.

Furthermore, said designing of the outer wall 7 of the WC container 2 in various configurations (in the form of the flange 15 or in the form of the additional flange 17, or in the form of the combination of the flanges 15 and 17) with the electric heaters 3 and 18 mounted thereon, and with the temperature sensor 12 mounted on the additional flange 17, allows to accelerate and to make the mounting/dismounting of the WC container 2 within/from within the HWS container 1 more convenient in order to provide rapid replacement and/or repair of the electric heater 3, additional electric heaters 18 and temperature sensor 12.

Each of the two embodiments of the double-circuit electric boiler may be designed such that it comprises "a pumping group" in the form of a set of additional details and devices such as: the flow monitoring sensor 19 for the liquid heat-carrying agent of the warming circuit, the pump 20, the safety valve 21 and the expansion tank 23 of the warming circuit. Said appliances are mounted with elements of the warming circuit and arranged beyond the WC container 2 and the HWS container 1, e.g., at the outlet pipe 22 of the warming circuit, the pipe being connected to the outlet duct 8 of the warming circuit. Said elements of the "pumping group" may be arranged both inside and outside the housing 5 of the boiler. Said elements and details of the "pumping group" are intended to enhance the movement of the heat-carrying agent within the warming circuit (the pump 20), to control the flow of the liquid heat-carrying agent within the warming circuit and to transmit this data to the flow control elements (the sensor 19), as well as to increase the operation safety of the warming circuit of the boiler (the safety valve 21 and the expansion tank 23). Said details of the "pumping group" are known as such and are standard elements of such boiler structures for warming of the room, but in the system of each of the two embodiments of the proposed double-circuit electric boiler, their connection with the container from one side and with the room warming system from another side, improves the structure and operation of each of the two embodiments of the boiler, and, due to acceleration of the flow of the heat-carrying agent within the warming circuit system, it allows to enhance the achievement of the technical effect for both embodiments of the invention in terms of increase of the stability of supplying the heat-carrying agent to the warming system and to increase the heat efficiency of the double-circuit electric boiler.

In separate design variants of the second embodiment of the invention, the double-circuit electric boiler may comprise the flange 28 that is mounted and sealably secured in the corresponding technological opening of one of the outer walls of the HWS container 1 (e.g., in the opening of the mounting wall 16 that may be the bottom of the HWS container 1, but without limitation thereto). The at least one electric heater 27 for the water in the HWS container 1 and the temperature sensor 13 for the water in the HWS container 1 are sealably secured to the flange 28 in such a way that these two appliances are arranged inside the HWS container 1. The presence of the flange 28 in the structure of the second embodiment of the boiler allows to improve and to diversify the structure of the second embodiment of the boiler in order to achieve more convenient mounting and securing of the electric heater 27 for the water and the temperature sensor 13 for the water in the HWS container 1. The flange 28 as a separate detail enables to mount/dismount the electric heater 27 for the water and the temperature sensor 13 for the water in the HWS container 1 or from the HWS container 1 with no need to dismount the entire boiler or the entire HWS container 1. That is, if the WC container 2 is disposed inside the HWS container 1 (according to the invention), then during dismounting of the HWS container 1 the WC container 2 is dismounted and stops to operate, thereby terminating the supply of the heat-carrying agent to the room warming system (that is very undesirable during the warming period of the year). When the flange 28 is present as a separate detail on which the electric heater 27 for the water and the temperature sensor 13 for the water in the HWS container 1 are mounted, it is enabled to rapidly and conveniently dismount this electric heater 27 for the water and the temperature sensor 13 for the water in the HWS container 1 in order to perform their routine repairing or replacement without stopping the operation of heating the heat-carrying agent in the WC container 2 and without stopping its supply to the room warming system. Therefore, the presence of the flange 28 as a separate detail in the second embodiment of the boiler allows to enhance the achievement of the technical effect in terms of the achievement of a more stable overall operation of the double-circuit electric boiler.

In each of the two embodiments of the invention, the boiler control elements for the double-circuit boiler may be made in the form of an electronic system that basically comprises a controller 25, and this electronic system is assembled on a control panel 26 that is secured on a wall of the boiler housing 5. The control panel 26 may comprise a display, sensitive or mechanical switch on/off devices, buttons and other elements of the electronic control system for the boiler, which allow consumers to switch on, to switch off, to adjust and to monitor the boiler operation.

In the first embodiment of the invention, the power supply, the electric heater 3 and the temperature sensor 12 for the heat-carrying agent of the warming circuit, in separate variants, the at least one additional electric heater 18 of the warming circuit, the temperature sensor 13 for the water in the HWS container 1, and, if the "pumping group" is present, the flow control sensor 19 for the liquid heat-carrying agent of the warming circuit and the warming circuit pump 20, may be coupled to the control panel 26. In the second embodiment of the invention, the at least one electric heater 27 for the water in the HWS container 1 also may be coupled to the control panel 26. The control of the boiler operation may be performed by the consumer "manually" by adjusting certain parameters of the boiler operation (e.g., by adjusting the temperature and periodicity of switching on/off of the electric heaters 3, 18, 27) or the control of the boiler operation may be performed automatically by means of algorithms, which are programmed within the controller 25. The presence, in the structure of each of the two embodiments of the boiler, of the control panel 26 that is based on the operation of the controller 25 to which the electric heaters 3, 18, 27, the sensors 12, 13, 19 and the pump 20 are coupled, allows to perform the effective and precise control of the operation of the electric heaters 3, 18, 27 depending on parameters of the heat-carrying agent of the warming circuit and of the water of the hot water supply circuit (in particular, on their temperature), which are transmitted to the control panel and to the controller 25 from the temperature sensors 12 and 13. That is, the information which is continuously provided to the control panel from the temperature sensors 12 and 13 allows the controller 25 to process this information continuously and rapidly, and, by means of the control electronic signals, to change the electric independent loading on the electric heaters 3, 18, 27, and, as a consequence, to change the temperature within the warming circuit and within the hot water supply circuit. Also, the consumer, with consideration of the data from the temperature sensors 12, 13, is allowed to change the operation parameters of the electric heaters 3, 18, 27 manually without assistance (without using the controller 25) through the control panel 26 and to reach the required temperature within the room warming system as well as the temperature of the water in the HWS container 1. Thus, the presence of the control elements, which are made in the form of the electronic system that is arranged on the control panel 26 and is based on the controller 25, in each of the two embodiments of the boiler facilitates a more effective achievement of the technical effect:

- in the first embodiment of the invention, in terms of the increasing the heat efficiency of the double-circuit electric boiler (due to the possibility of the precise adjustment of the operation of the electric heaters 3, 18, 27 of the boiler);
- in the second embodiment (due to the possibility of the precise adjustment of the operation of the electric heaters 3, 18, 27 of the boiler), in terms of increasing the heat efficiency of the double-circuit electric circuit; increasing the stability of heating of the hot water within both circuits and increasing the stability of supplying of the heat-carrying agent to the warming system and increasing the stability of supplying the hot water for domestic use.

PRACTICAL IMPLEMENTATION OF THE INVENTION

Brief description of block diagrams of the proposed invention.

Figure 2:
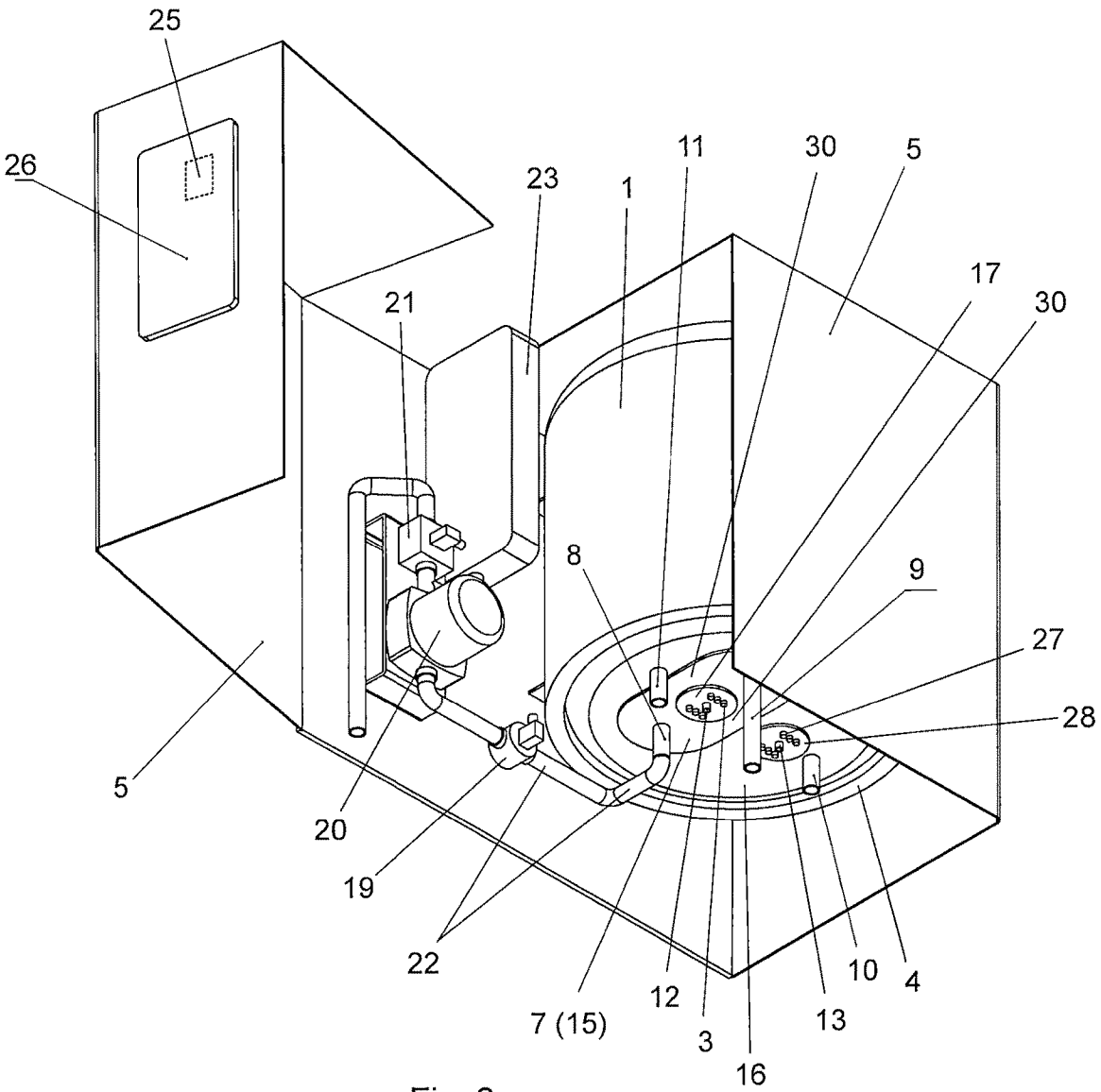
Figure 3:
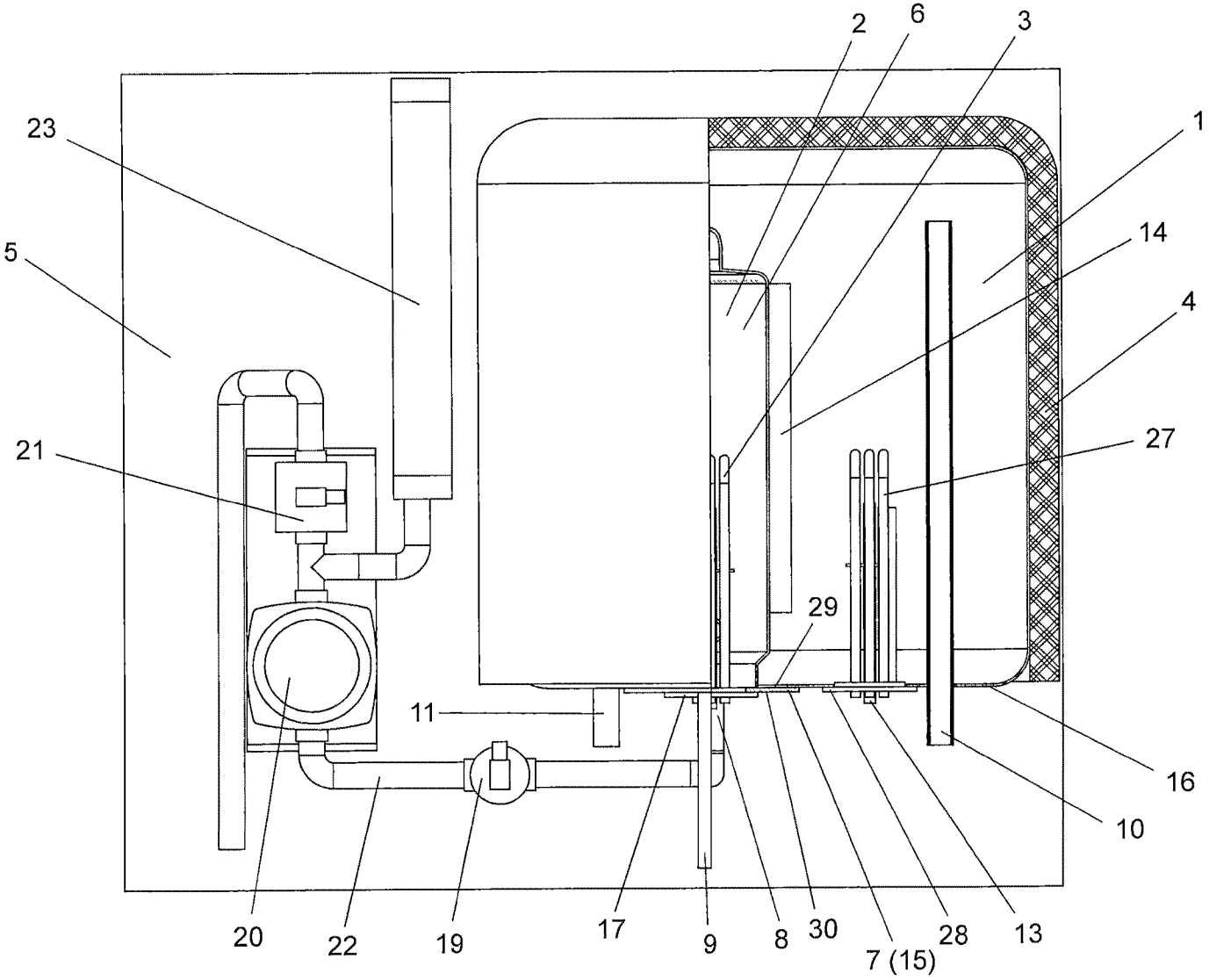
Figure 4:
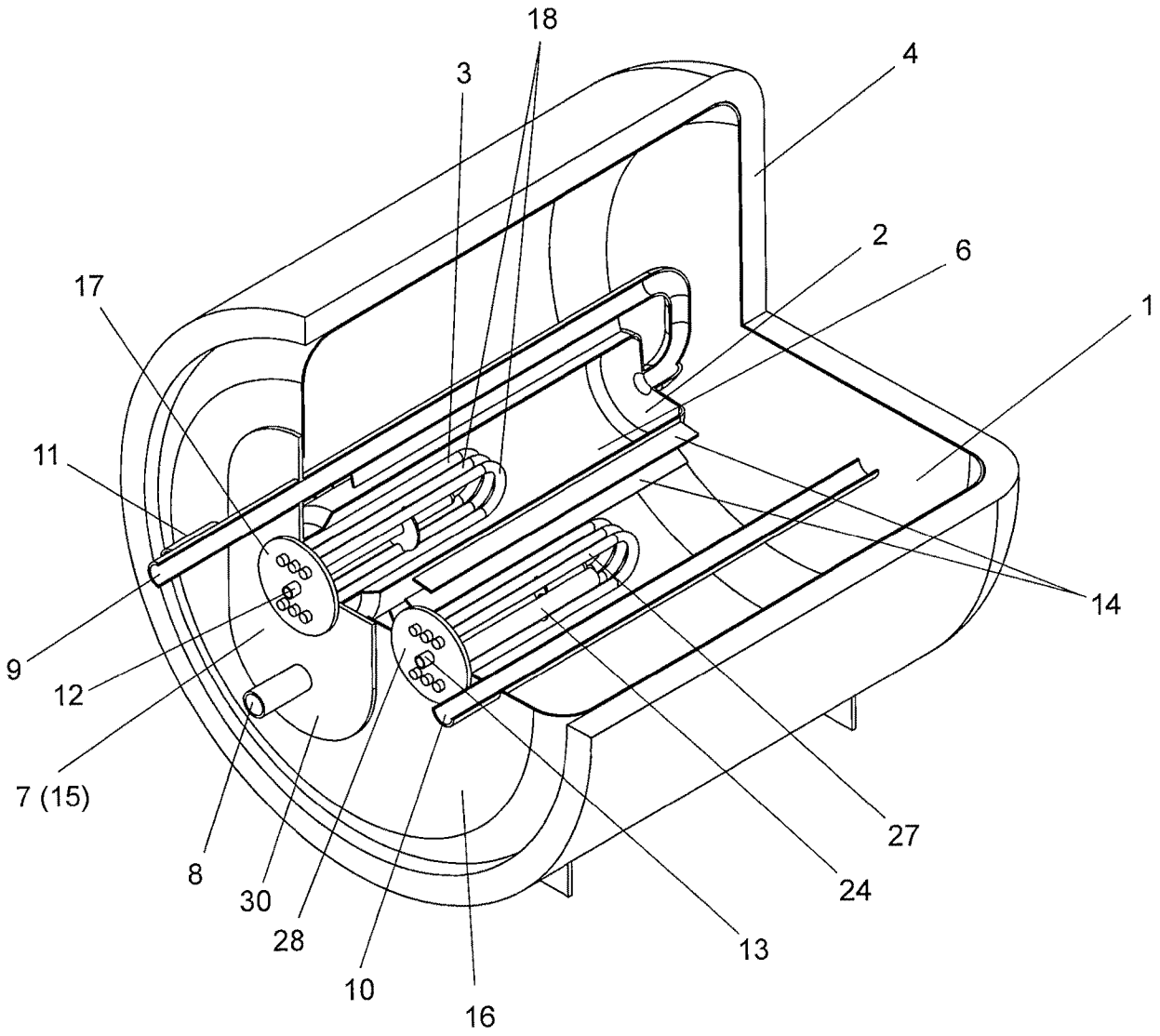
Figure 5:
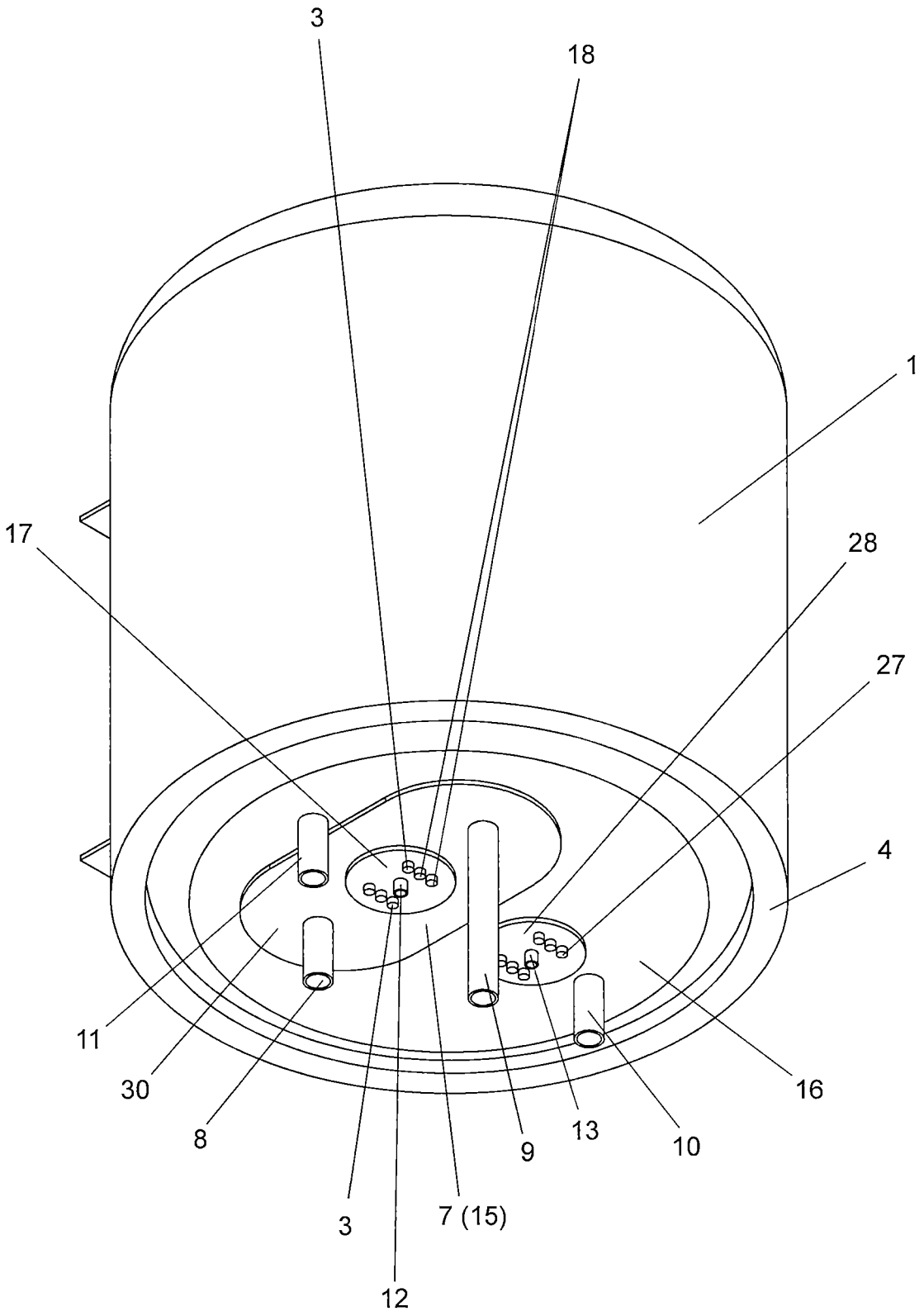
Figure 6:
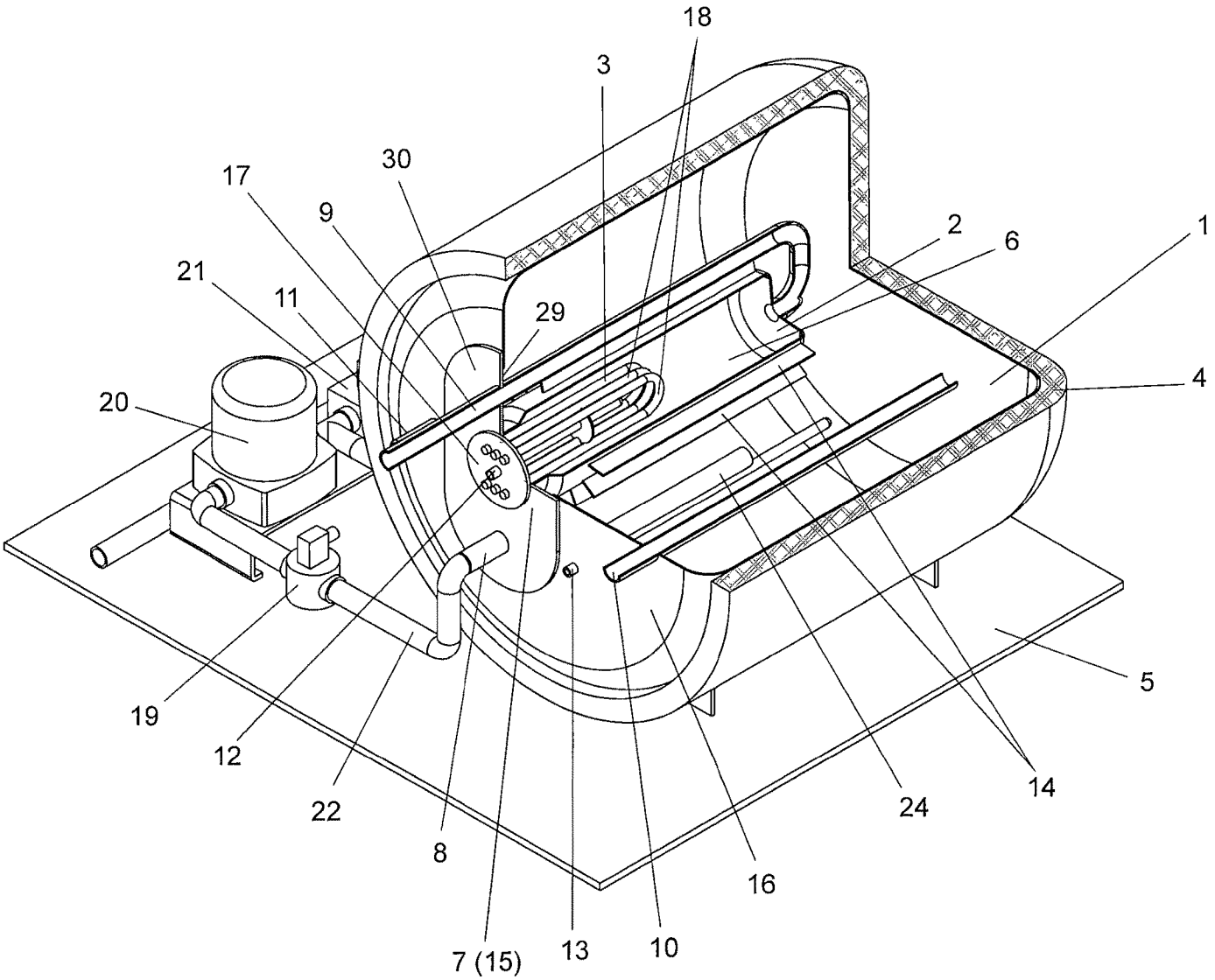
Figure 7:
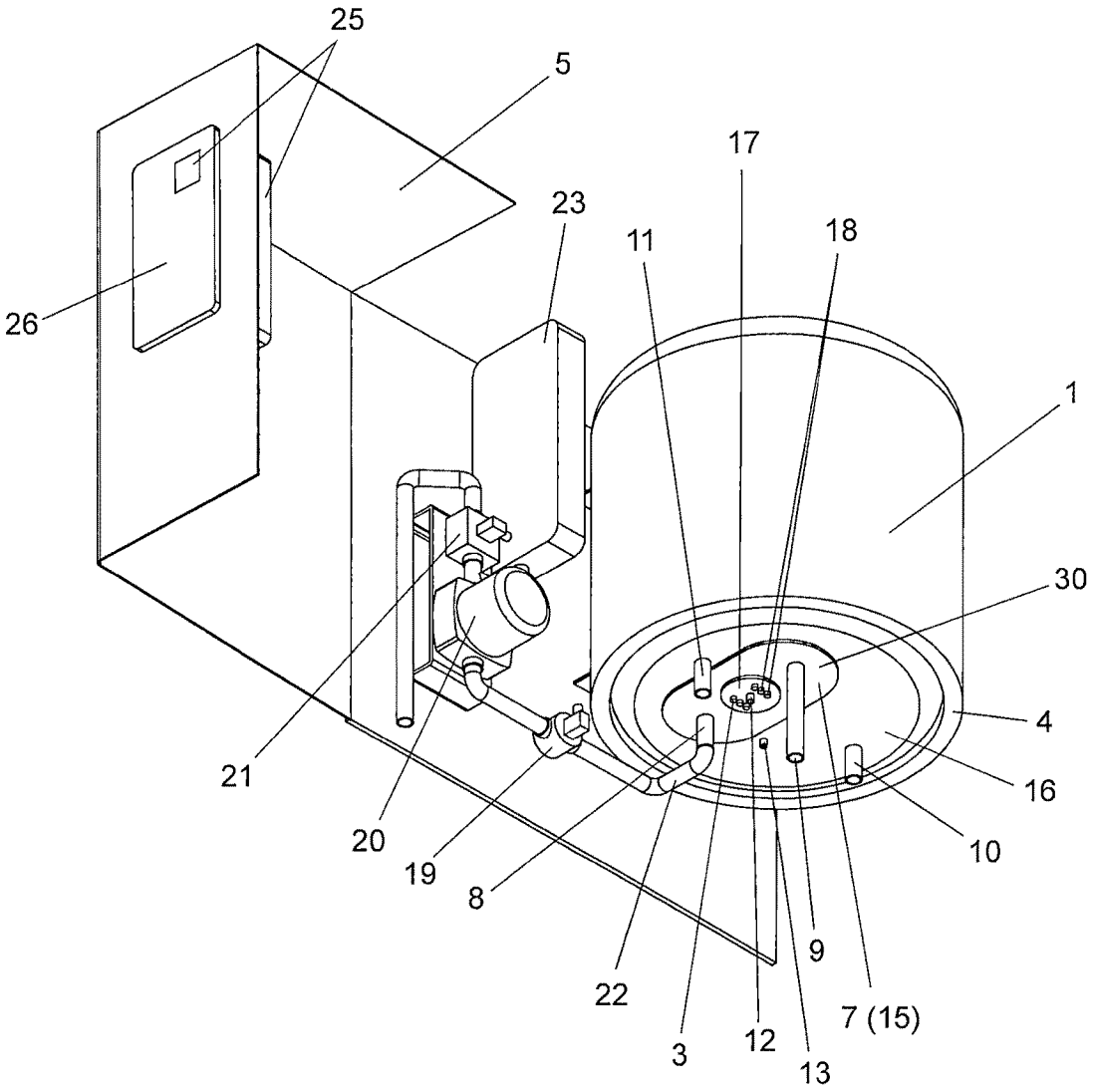
Figure 8:
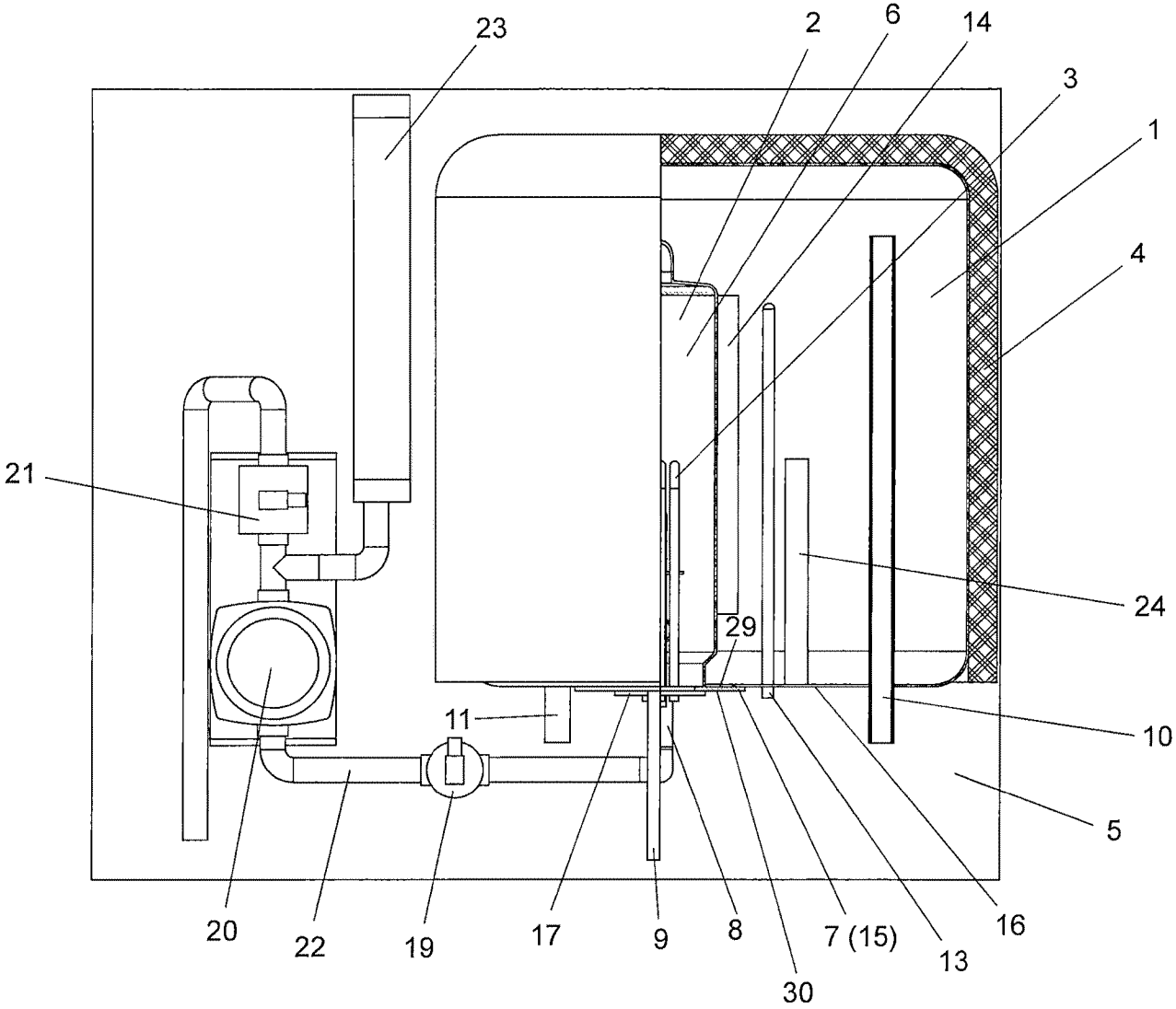
Figure 9:
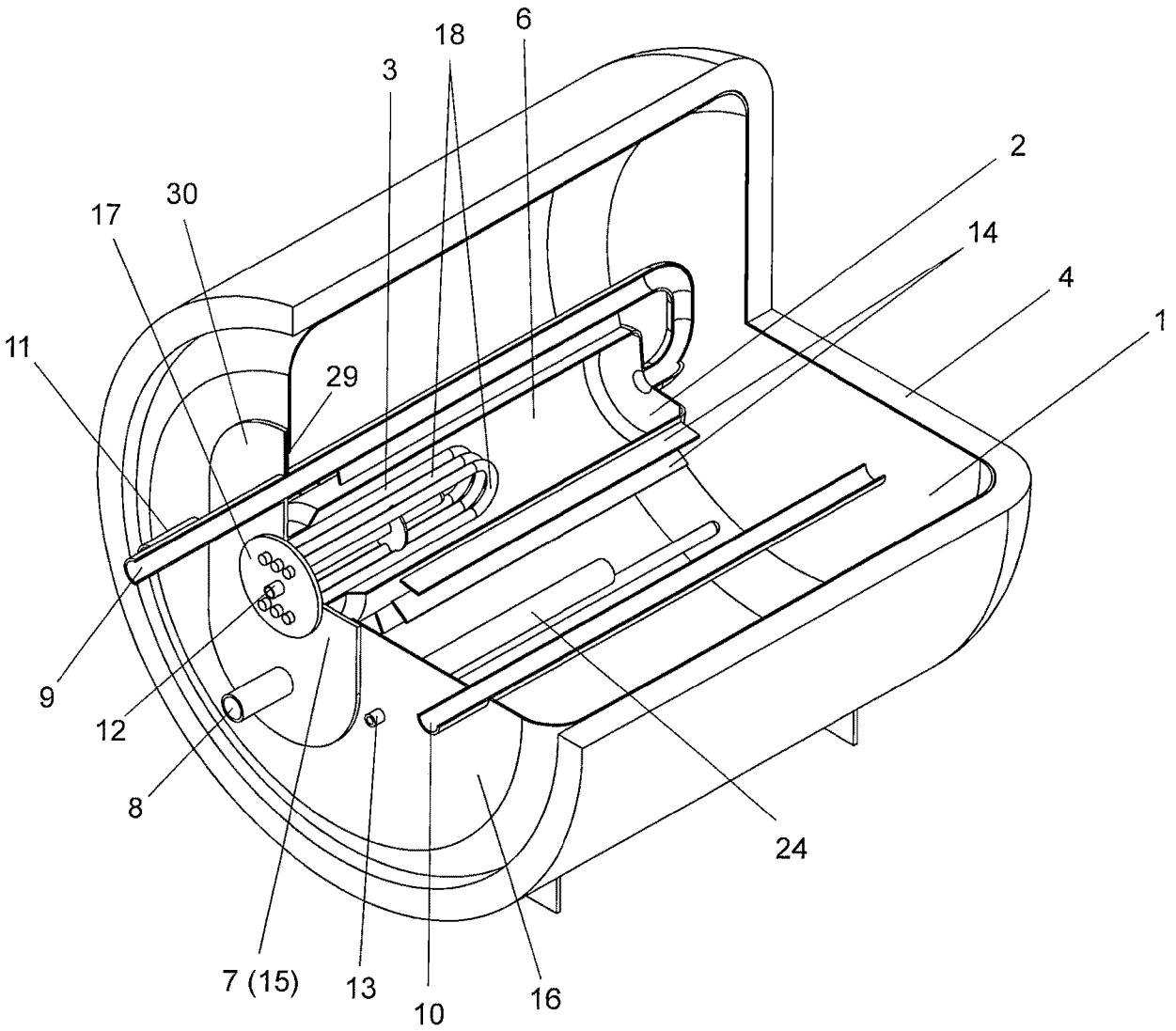
Figure 10:
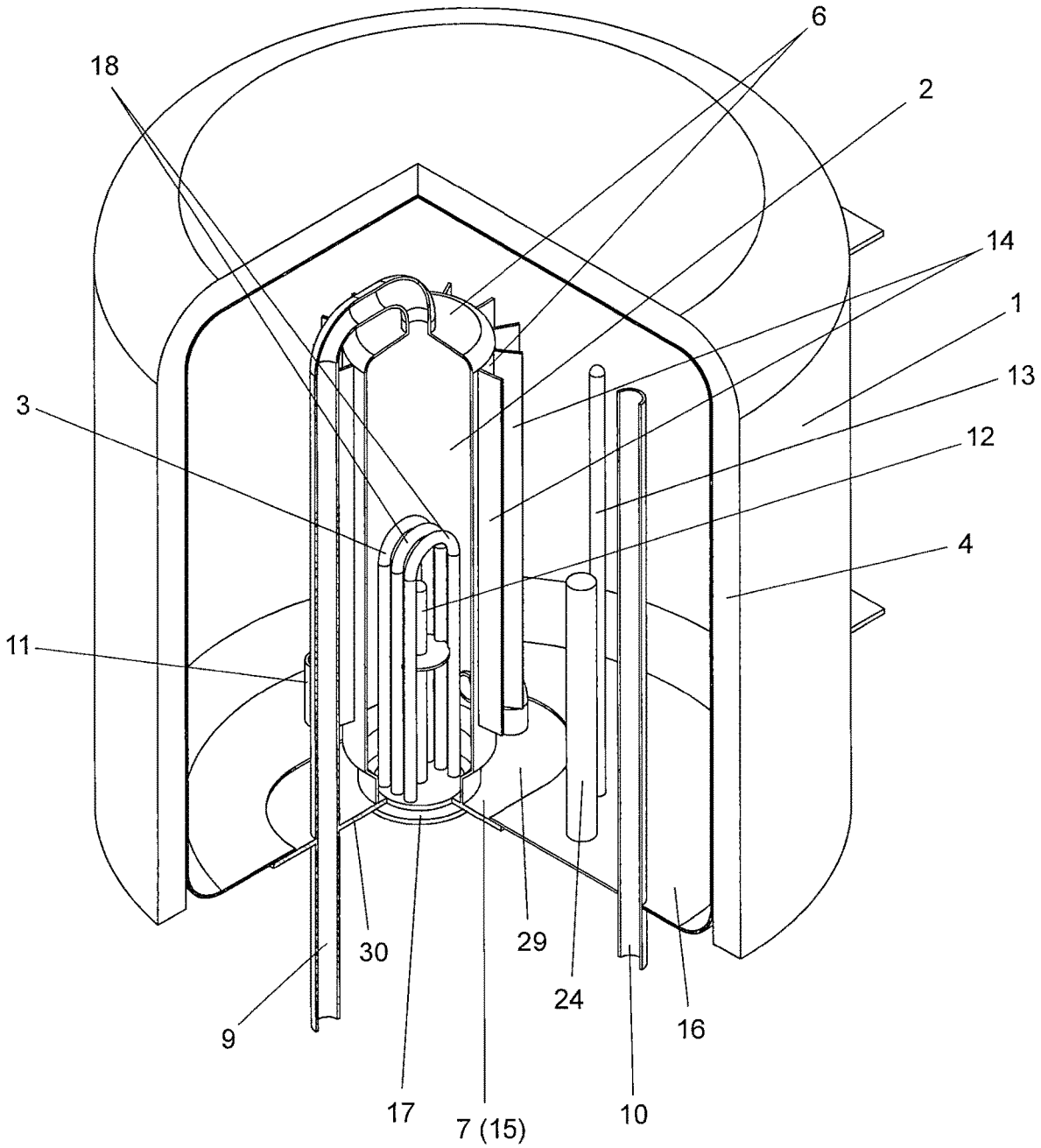
Figure 11:
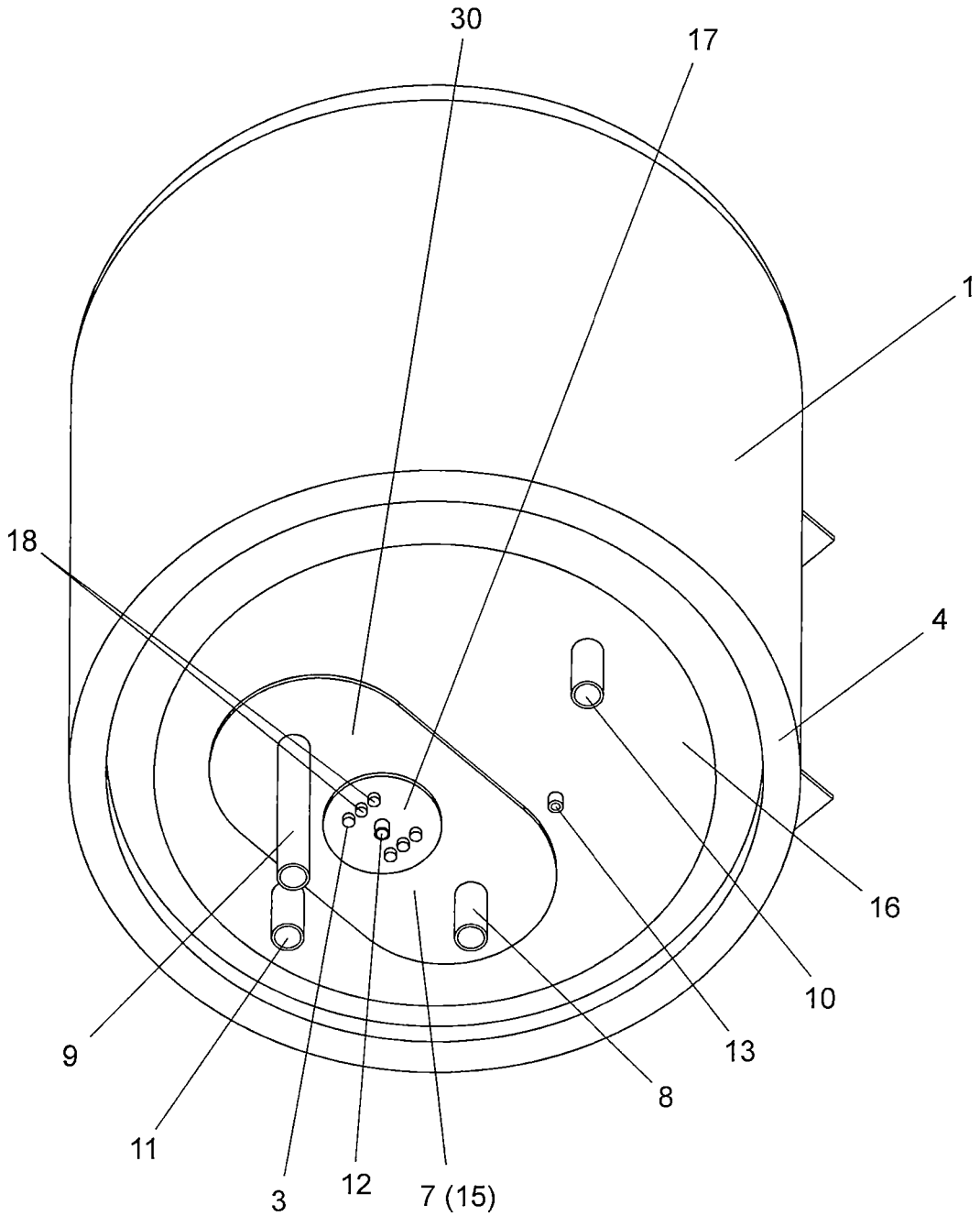
Figure 12:
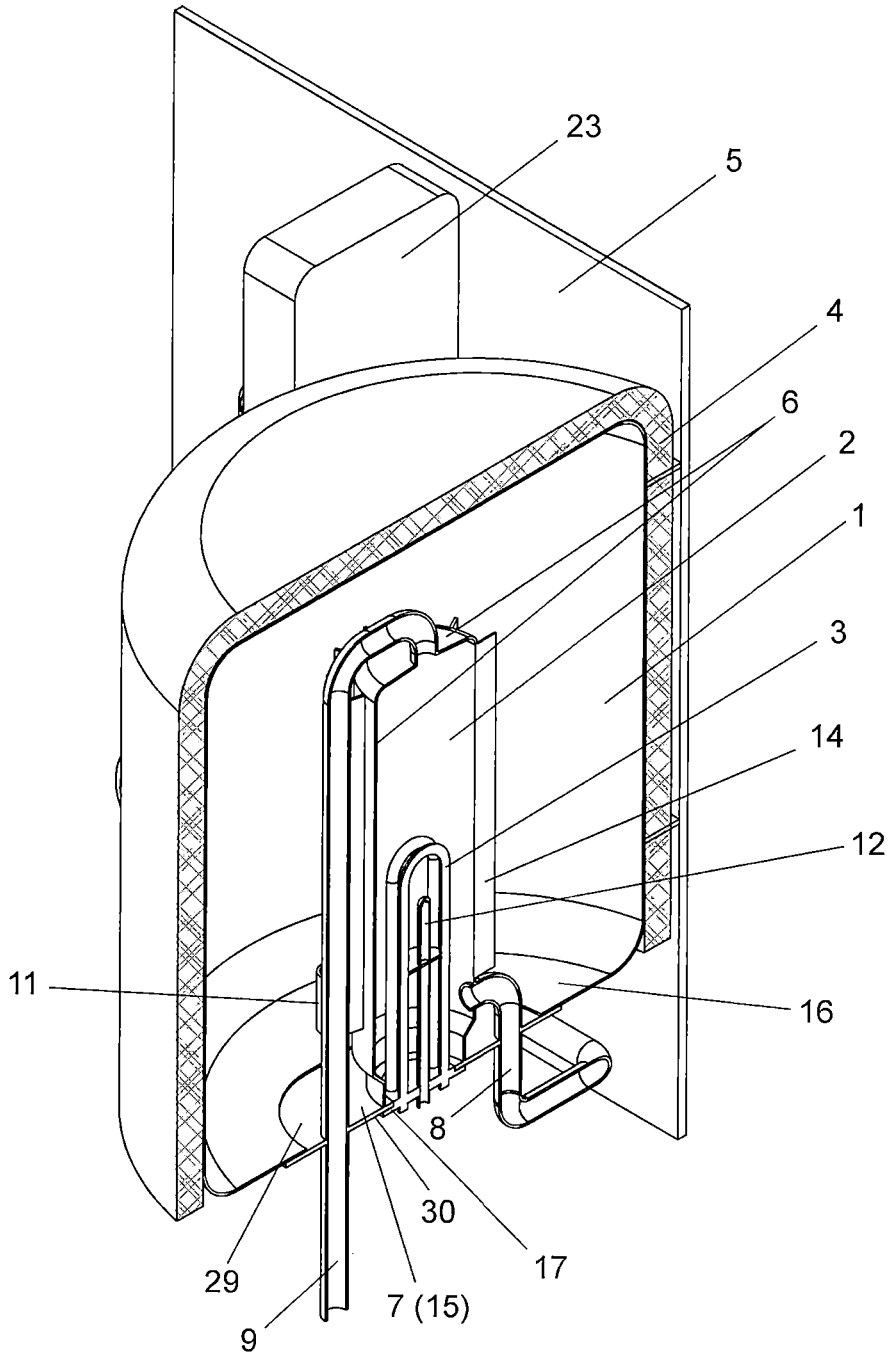

Practical implementation and industrial applicability of the double-circuit electric boilers explained by schematic views of the structure, in which:

FIG. 1—the double-circuit electric boiler with the electric heater 3 of the warming circuit and the electric heater 27 of the hot water supply circuit, and with external elements and details;

FIG. 2—the double-circuit electric boiler with the electric heater 3 of the warming circuit and the electric heater 27 of the hot water supply circuit, and with external elements and details, as well as with the housing 5;

FIG. 3—the double-circuit electric boiler with the electric heater 3 of the warming circuit and the electric heater 27 of the hot water supply circuit, and with external elements and details (side view);

FIG. 4—the double-circuit electric boiler with the electric heater 3 of the warming circuit and the electric heater 27 of the hot water supply circuit without external elements and details (side view ¾, cross-section);

FIG. 5—the double-circuit electric boiler with the electric heater 3 of the warming circuit and the electric heater 27 of the hot water supply circuit without external elements and details (bottom view ¾);

FIG. 6—the double-circuit electric boiler with the electric heater 3 of the warming circuit (without the electric heater 27 of the hot water supply circuit), and with external elements and details;

FIG. 7—the double-circuit electric boiler with the electric heater 3 of the warming circuit (without the electric heater 27 of the hot water supply circuit), and with external elements and details, as well as with the housing 5;

FIG. 8—the double-circuit electric boiler with the electric heater 3 of the warming circuit (without the electric heater 27 of the hot water supply circuit), and with external elements and details (side view);

FIG. 9—the double-circuit electric boiler with the electric heater 3 of the warming circuit (without the electric heater 27 of the hot water supply circuit) without external elements and details (side view ¾, cross-section);

FIG. 10—the double-circuit electric boiler with the electric heater 3 of the warming circuit (without the electric heater 27 of the hot water supply circuit) without external elements and details (top view ¾, cross-section);

FIG. 11—the double-circuit electric boiler with the electric heater 3 of the warming circuit (without the electric heater 27 of the hot water supply circuit) without external elements and details (bottom view ¾);

FIG. 12—coupling of the outlet duct 8 to the container 2 of the warming circuit inside the container 1 of the double-circuit electric boiler.

Elements of the structure of both embodiments of the invention are designated with the following numeric positions:

1—the container for the water of the hot water supply circuit;
2—the container for the heat-carrying agent of the warming circuit;
3—the at least one electric heater of the heat-transfer of the warming circuit;
4—the heat insulation layer of the container 1 of the hot water supply circuit;
5—the housing of the boiler;
6—the inner walls of the container 2 of the heat-carrying agent of the warming circuit;
7—the outer wall of the container 2 of the heat-carrying agent of the warming circuit;
8—the outlet duct (for drain of the heat-carrying agent) from the container 2 of the warming circuit;
9—the inlet duct (for supply of the heat-carrying agent) into the container 2 of the warming circuit;
10—the outlet duct (for drain of the heated water) from the container 1 of the hot water supply circuit;
11—the inlet duct (for supply of a cold water) into the container 1 of the hot water supply circuit;
12—the temperature sensor for the heat-carrying agent in the container 2 of the warming circuit;
13—the temperature sensor for the water in the container 1 of the hot water supply circuit;
14—the heat exchange ribs of the container 2 of the warming circuit;
15—the outer wall 7 of the container 2, the wall being made in the form of a flange of the container 2 of the heat-carrying agent of the warming circuit;
16—mounting wall of the container 1 of the hot water supply circuit;
17—an additional flange of the electric heater 3 of the heat-carrying agent of the warming circuit;
18—additional electric heaters of the heat-carrying agent of the warming circuit;
19—the flow control sensor for the liquid heat-carrying agent of the warming circuit;
20—the warming circuit pump;
21—the safety valve of the warming circuit;
22—the outlet pipe of the warming circuit;
23—the expansion tank of the warming circuit;
24—a magnesium anode of the container 1 of the hot water supply circuit;
25—the controller;
26—the control panel;
27—the electric heater for the water of the hot water supply circuit;
28—the flange of the electric heater 27 for the water of the hot water supply circuit;
29—the inner surface of the outer wall 7 of the container 2 of the heat-carrying agent of the warming circuit;

30—the outer surface of the outer wall 7 of the container 2 of the heat-carrying agent of the warming circuit.

Best examples of implementation of both embodiments of the invention.

DESCRIPTION OF THE STRUCTURE OF THE FIRST EMBODIMENT OF THE INVENTION

The structure of the first embodiment of the proposed double-circuit electric boiler comprises the following main constituent elements (FIG. 6-FIG. 12): the container 1 for the water of the hot water supply circuit (hereinafter briefly referred to as the HWS container 1) with the outer heat insulation layer 4 that is made in the form of a warming layer of any material that may be used in manufacturing such boilers; the container 2 for the heat-carrying agent of the warming circuit (hereinafter briefly referred to as the WC container 2) having inside the at least one electrical heater 3 of the heat-carrying agent of the warming circuit; a housing 5 (FIG. 6-8, FIG. 12), in which the HWS container 1, the WC container 2 and other components of the boiler are mounted; the power supply system and the boiler control elements. Therewith, the HWS container 1 comprises an outlet duct 10 (for drain of a heated water) and an inlet duct 11 (for feeding a cold water into the HWS container 1), while the WC container 2 comprises an inlet duct 8 (for drain of the heat-carrying agent) and the inlet duct 9 (for feeding the heat-carrying agent into the WC container 2).

The Power Supply System.

The double-circuit electric boiler is coupled to the mains at an input electric terminal that may be disposed inside the boiler housing 5. The electric principal diagram of the boiler implies a presence of a grounding circuit having a resistance of not more than 20 Ohm in a room, wherein the device is to be mounted.

The coupling may be made to a three-phase or single-phase mains depending on the heating power of the boiler.

The heating power of the double-circuit electric boiler is defined by a heating power of not more than one electric heater 3 (or as a sum of ratings of one electric heater 3 and several additional electric heaters 18) of the warming circuit and is in the range between 2 kW and 100 kW.

The electric power of the first embodiment of the double-circuit electric boiler is defined as a power of not more than one electric heater 3 (or as a sum of ratings of one electric heater 3 and several additional electric heaters 18) of the warming circuit. The electric heater 3 of the warming circuit is coupled by a separate individual conductor that is comprised in the double-circuit electric boiler.

As it has been already mentioned, in various design variants of both embodiments of the invention, the electric heater 3 of the warming circuit may be represented by several electric heaters (a cascade of heaters: the main electric heater 3 and the additional electric heaters 18, FIG. 6, 7, 9, 10, 11) that may allow to avoid imposing a load to the mains during use of the boiler.

The electric heater 3 of the warming circuit and the additional electric heaters 18 of the warming circuit (when they are comprised in the boiler) are controlled by the controller 25 (FIG. 2, 7).

The control elements of the boiler may include: on/off switches, power regulators of the electric heaters, fuses, the controller 25, a display and other standard devices and components, which enable to switch on, switch off the boiler and to control the operation thereof. Most of the boiler control elements are comprised in the control panel 26 (FIG. 2, 7) that may be disposed and secured on one of the housing 5 walls, but without limitation thereto. It should be noted that in the structure of both embodiments of the proposed double-circuit electric boiler, the "controller" is a customized component of the system that is formed from the control elements of the boiler, and this controller is intended to control certain components and devices of the boiler, which are coupled to the controller. Various known structures of controllers, which are used in the field of manufacturing and use of such devices, may be used in the structure of the proposed boiler. The controller 25 is intended to provide safety, control accuracy and programming the usage modes of the double-circuit electric boiler. In various variants and in separate embodiments of the boiler structure, various elements and members of the device may be coupled to the controller 25.

Each of the containers (the HWS container 1 and the WC container 2) is formed of metal walls and may have, e.g., a circular or a cylindrical shape, but without limitation thereto. The WC container 2 has a smaller size and a smaller volume than a size and a volume of the HWS container 1. According to the invention, the WC container 2, together with the at least one electric heater 3 of the heat-carrying agent of the warming circuit mounted therein, is mounted and sealably and rigidly secured inside the HWS container 1 (FIG. 6, 8, 9, 10, 12) such that there is totally no contact between the heat-carrying agent that is disposed inside the WC container 2 and the water that is disposed inside the HWS container 1, i.e. these liquids are isolated from each other by the inner walls 6 of the WC container 1 (FIG. 6, 8, 9, 10, 12). Due to such structural solution, it becomes possible to achieve a part of the technical effect, namely to combine two electric devices (the warming one and the water heating-water supply one) into a single device and, thus, to optimize and to reduce sizes and dimensions of the overall structure in order to save (reduce) an area for mounting and use of the device in domestic conditions. That is, as compared to the most of known technical solutions, the warming and the water-heating and water-supplying devices are separate and independent structures, each having its own dimensions and each occupying a certain area and a volume when mounted and during use. And, as it has been already mentioned, the structure of both embodiments of the proposed invention (according to the principle "two-in-one") enables to optimize and to reduce the sizes and dimensions of the boiler for simultaneous warming and water-heating and water-supplying, as well as to save (reduce) the area for mounting and use of the device in domestic conditions.

As the electric heater 3 (or several electric heaters 3 and 18) of the heat-carrying agent of the warming circuit in the boiler structure, various types of the known electric heaters may be used, including: induction, tubular electric heaters or thermoelectric heaters, but without limitation thereto. The electric heater 3 of the liquid of the heat-carrying agent in the WC container 2 is intended to provide a smooth heating of the heat-carrying agent of the warming circuit (in order to avoid the overload of the mains). The at least one electric heater 3 of the heat-carrying agent of the warming circuit is coupled to the power supply system, is connected to the controller 25 and to the control panel 26.

The HWS container 1 comprises at least one mounting wall 16 (FIG. 6-12), and the WC container 2 also comprises at least one mounting wall that is one of surfaces of the WC container 2 and, at the same time, is the outer wall 7 (FIG. 6-12) that is disposed and secured outside the HWS container 1 such that the inner surface 29 (FIG. 8, 10, 12) of this outer wall 7 is in contact with the mounting wall 16 of the HWS container 1, while the outer surface 30 (FIG. 6, FIG.

8-12) of the outer wall 7 of the WC container 2 is located outside the HWS container 1. In the assembled and operational state of the boiler, when the WC container 2 is inserted and secured inside the HWS container 1, the outer surfaces of the inner walls 6 of the WC container 2 (that is disposed inside the HWS container 1) are disposed in a direct physical contact with the water of the hot water supply circuit inside the container 1. Therewith, the at least one electric heater 3 of the heat-carrying agent of the warming circuit is fully isolated by the inner walls 6 of the WC container 2 of the warming circuit from a direct physical contact with the water of the hot water supply circuit that is disposed inside the HWS container 1 (FIG. 6, 8, 9, 10, 12).

As it has been already mentioned, the WC container 2 comprises the outlet duct 8 and the inlet duct 9. The outlet duct 8 and the inlet duct 9 are sealably mounted and secured in the technological openings of the outer wall 7 and the WC container 2, while end openings of each of the ducts 8 and 9 are sealably connected to the corresponding technological openings of the WC container 2 inside the HWS container 1 (FIGS. 6-12). In the same way, the outlet duct 10 for drain of the water from the HWS container 1 and the inlet duct 11 for supplying the water into the HWS container 1 are sealably mounted and secured in the corresponding technological openings of one of the walls (in particular, in the mounting wall 16) of the HWS container 1 such that their end openings are disposed inside the HWS container 1 and areas of the outlet 10 and inlet 11 ducts, which are disposed inside the HWS container 1, are fully isolated by the inner walls 6 of the WC container 2 from a contact with the heat-carrying agent in the WC container 2 (FIG. 6-12).

Inside the WC container 2, there is mounted a temperature sensor 12 for the heat-carrying agent in the WC container 2 such that this temperature sensor 12 is fully isolated by the inner walls 6 of the WC container 2 from a contact with the water that is disposed in the HWS container 1 (FIG. 6, 7, FIG. 9-12). The temperature sensor 12 for the heat-carrying agent of the warming circuit in the WC container 2 is intended to fix values of the temperature of the heat-carrying agent (e.g., water) of the warming circuit inside the WC container 2. The temperature sensor 12 transmits signals to the controller 25.

Inside the HWS container 1, also there is mounted a temperature sensor 13 for the water in this HWS container 1 such that this temperature sensor 13 is fully isolated by the inner walls 6 of the WC container 2 from a contact with the heat-carrying agent in the HWS container 2 (FIGS. 6-11). The temperature sensor 13 for the water of the hot water supply circuit is intended to fix values of the temperature of the water of the hot water supply circuit inside the HWS container 1. The temperature sensor 13 transmits signals to the controller 25.

The structure of the proposed boiler may utilize both the temperature sensors 12 and 13, and any known structures of temperature sensors, which are used during manufacturing and use of such devices.

Description of the Structure of the Second Embodiment of the Invention

The structure of the second embodiment of the proposed double-circuit electric boiler comprises the same main constituent elements as the first embodiment, however, as opposed to the first embodiment, in the second embodiment of the invention, the at least one electric heater 27 for the water of the hot water supply circuit is mounted inside the HWS container 1 (FIG. 1-5). This electric heater 27 for the water of the hot water supply circuit is mounted and sealably secured in the corresponding technological opening of one of the walls (in particular, in the mounting wall 16) of the HWS container 1 such that the heating areas of the electric heater 27 are disposed inside the HWS container 1 and are fully isolated by the inner walls 6 of the WC container 2 from the contact with the heat-carrying agent in the WC container 2 (FIG. 1, 3, 4).

The electric heater 27 of the hot water supply circuit is coupled by a separate individual conductor that is comprised in the double-circuit electric boiler.

The electric heater 27 of the hot water supply circuit is controlled by the controller 25 (FIG. 2).

The electric power of the second embodiment of the double-circuit electric boiler is defined as a sum of the electric power of the at least one electric heater 3 of the warming circuit and the electric power of the electric heater 27 for the water of the hot water supply circuit, or as a sum of electric powers of one electric heater 3 of the warming circuit, several additional electric heaters 18 of the warming circuit and the electric heater 27 for the water of the hot water supply circuit.

Separate design variants of the two embodiments of the boiler structure.

In separate design variants of the invention, in the structure of both embodiments of the boiler, on the outer surfaces of the inner walls 6 of the WC container 2 the heat exchange ribs 14 may be disposed (FIG. 1, 3, 4, 6, 8, 9, 10, 12), which surfaces have a physical contact with the water inside the HWS container 1. The heat exchange ribs 14 are intended to enhance and to increase heat exchange processes between the WC container 2 that is heated by the heat-carrying agent of the warming circuit and the water that is heated inside the HWS container 1. Conversely, the heat exchange ribs 14 are also intended to enhance and to increase heat exchange processes between the heated water inside the HWS container 1 and the WC container 2 that, in turn, transfers the heat from the ribs 14 to the walls 6 and then to the heat-carrying agent inside the WC container 2.

Also, in separate design variants of the invention, in the structure of both embodiments of the boiler, the outer wall 7 of the WC container 2 may be made in the form of the flange 15 that is a bottom of the WC container 2 at the same time (FIGS. 1-12). In such cases, the flange 15 is coupled to the inner walls 6 in the lower portion of the WC container 2, wherein the outer wall 7 in the form of the flange 15 is configured to be sealably secured to one of the walls (in particular, to the mounting wall 16) of the HWS container 1.

Furthermore, in separate design variants of the invention, in the structure of both embodiments of the boiler, the at least one electric heater 3 of the heat-carrying agent of the warming circuit may be mounted and fixed to the additional flange 17 that, in turn, is mounted and sealably secured in the corresponding technological opening of the outer wall 7 of the WC container 2 (FIGS. 1-12). Or in other cases, the electric heater 3 of the heat-carrying agent of the warming circuit may be mounted and sealably secured in the corresponding technological opening of the outer wall 7 that is made in the form of the flange 15 that is the bottom of the WC container 2. Also, in various embodiments of the boiler structure, the temperature sensor 12 for the heat-carrying agent in the WC container 2 may be mounted and sealably fixed to the additional flange 17 of the electric heater 3.

In various design variants of each of the two embodiments of the invention (depending on the required heating power of the boiler), the structure may comprise one or more additional electric heaters 18 of the heat-carrying agent of the warming circuit, which is/are mounted and sealably secured in the corresponding technological opening of the outer wall 7 of the WC container 2 (FIG. 1, 4, 5, 6, 7, 9, 10, 11). Also, the one or more additional electric heaters 18 of the heat-carrying agent of the warming circuit may be mounted and fixed to the additional flange 17 that is, in turn, mounted and sealably secured in the corresponding technological opening of the outer wall 7 of the WC container 2 or in the technological opening of the outer wall 7 that is made in the form of the flange 15 that is the bottom of the WC container 2.

Each of the two embodiments of the invention, in various separate design variants and use cases of the structure, further comprises a so-called "pumping group" of members and elements, which are intended to enhance the circulation of the heat-carrying agent in the warming circuit of the system of the boiler and warming elements for the room (for example, pipes, radiators). That is, each of the embodiments of the boiler may further comprise: the flow control sensor 19 for the liquid heat-carrying agent of the warming circuit, the pump 20 of the warming circuit and the safety valve 21 of the warming circuit, which are mounted on the outlet pipe 22 of the warming circuit (FIG. 1, 2, 3— the second embodiment, FIG. 6, 7, 8— the first embodiment) that is, in turn, coupled to the outlet duct 8 for drain of the heat-carrying agent from the WC container 2. In such embodiments of the invention, the expansion tank 23 is coupled to the outlet pipe 22 of the warming circuit (FIG. 3, 2, 7, 8).

In both embodiments of the invention, a magnesium anode 24 may be mounted in the container 2 of the hot water supply circuit (FIG. 1, 4 in the second embodiment; FIG. 6, 8, 9, 10 in the second embodiment).

As it has been mentioned already, in both embodiments of the invention, the boiler control elements may be made in the form of the electronic system that comprises the controller 25, and this electronic system may be assembled on the control panel 26 that is secured on the wall of the boiler housing 5. The following may be coupled to the control panel 26: a power supply as well as at least one electric heater 3 of the heat-carrying agent of the warming circuit, the temperature sensor 12 for the heat-carrying agent of the warming circuit, the temperature sensor 13 for the water in the HWS container 1.

In cases, when the boiler comprises the "pumping group", the boiler control elements may be made in the form of the electronic system that comprises the controller 25, and this electronic system is assembled on the control panel 26 that is secured on the wall of the boiler housing 5. And the power supply as well as the at least one electric heater 3 for the heat-carrying agent of the warming circuit, the temperature sensor 12 for the heat-carrying agent of the warming circuit, the temperature sensor 13 for the water in the container 1 of the hot water supply circuit, the flow control sensor 19 for the liquid heat-carrying agent of the warming circuit and the pump 20 of the warming circuit may be coupled to the control panel 26.

If one or more additional electrical heaters 18 of the warming circuit are mounted in the boiler (in the WC container 2) apart from the one electric heater 3 for the heat-carrying agent of the warming circuit, then these additional electric heaters 18 are also correspondingly coupled to the control panel 26 and controlled by the controller 25.

In the second embodiment of the boiler structure, when the at least one electric heater 27 for the water of the hot water supply circuit is mounted in the HWS container 1, then this electric heater 27 for the water in the HWS container 1 may be mounted and secured to the flange 28 that is, in turn, mounted and sealably secured in the corresponding technological opening of one of the outer walls (in particular, in the mounting wall 16) of the HWS container 1. In the same way, the temperature sensor 13 for the water in the HWS container 1 may be also mounted to the flange 28 of the electric heater 27 for the water in the HWS container 1.

Also, in the second embodiment of the boiler structure, when the at least one electric heater 27 for the water of the hot water supply circuit is mounted in the boiler in the HWS container 1, then this electric heater 27 for the water in the HWS container 1 is coupled to the control panel 26 and controlled by the controller 25.

Both embodiments of the structure of the double-circuit electric boiler imply that it comprises at least four ducts for hydraulic connections (couplings), namely, these are: the inlet duct 9 (for supply of the heat-carrying agent) into the container 2 of the warming circuit, the outlet duct 8 (for drain of the heat-carrying agent) from the container 2 of the warming circuit, the inlet duct 11 (for supply of the cold water) into the container 1 of the hot water supply circuit and the outlet duct 10 (for drain of the heated water) from the container 1 of the hot water supply circuit. Additionally, in separate design variants of the invention, each of the embodiments of the boiler may comprise a vent duct (not shown in the drawings) for discharge of the water from the HWS container 1.

The outlet duct 10 for drain of the heated water from the HWS container 1 into the HWS circuit is firmly mounted into the corresponding technological opening of the HWS container 1 (e.g., into the mounting wall 16 of the HWS container 1). The inlet duct 11 is also firmly mounted into the technological opening of the HWS container 1 (e.g., into the mounting wall 16 of the HWS container 1).

The inlet duct 9 for supply of the heat-carrying agent into the WC container 2 "at the input" of the HWS container 1 is firmly mounted into the technological opening of the outer wall 7 of the WC container 2, and then this duct (being already inside the HWS container 1) is coupled (via the corresponding technological opening) to the WC container 2. Thus, the walls of the inlet duct 9 of the warming circuit, which are disposed inside the HWS container 1, are in the contact with the water that is disposed inside the HWS container 1. In the same way, the outlet duct 8 for drain of the heat-carrying agent from the WC container 2 into the room warming system "at the output" from the HWS container 1 is firmly mounted into the technological opening of the outer wall 7 of the WC container 2, while inside the HWS container 1 this outlet duct 8 of the warming circuit is coupled (via the corresponding technological opening that is not shown in the drawings) to the WC container 2. Thus, the walls of the outlet duct 8 of the warming circuit, which are disposed inside the HWS container 1, are in the contact with the water that is disposed inside the HWS container 1.

Outside the boiler, the outlet duct 8 for supply of the heat-carrying agent is coupled to the pipe of the warming circuit, e.g., to the outlet pipe 22 of the warming circuit in such a way as shown in the FIGS. 1-3, 7-8.

Description of the Operation of Each of the Two Embodiments of the Double-Circuit Electric Boiler.

The boiler is intended to heat the heat-carrying agent for the room warming system (the warming circuit is the "HC") with the simultaneous heating of the water for the hot water supply (the hot water supply circuit is the "HWS") for domestic needs. That is, the boiler structure implies the presence of two systems of heating the heat-carrying agents.

The operation of the first embodiment of the proposed double-circuit electric boiler is based on a unidirectional heat exchange between the heat-carrying agent of the WC and the water of the HWS circuit through surfaces of the WC container 2 (with the heat-carrying agent being present inside it), which are disposed inside the HWS container 1 and which are in the direct contact with the water in the HWS container 1. That is, the heat transfer inside the boiler takes place from the heated heat-carrying agent in the WC container 2 through the surfaces of the WC container 2 to the water inside the HWS container 1.

The operation of the second embodiment of the proposed double-circuit electric boiler is based on a mutual bidirectional heat exchange between the heat-carrying agent of the WC and the water of the HWS circuit through surfaces of the WC container 2, which are disposed inside the HWS container 1 and which are in the direct contact with the water in the HWS container 1. That is, the heat transfer inside the boiler takes place from the heated heat-carrying agent in the WC container 2 through the surfaces of the WC container 2 to the water inside the HWS container 1, and conversely from the water inside the HWS container 1 to the outer surfaces of the WC container 2 and further to the heat-carrying agent inside the WC container 2.

The double-circuit electric boiler is mounted in the room. The structure of the boiler housing 5 enables to fix it on a vertical wall. As it has been already mentioned, due to the fact that the WC container 2 is disposed inside the HWS container 1 and both these containers 1 and 2 are disposed inside the housing 5, as compared to the analogous systems of warming and hot water supply, which are designed as separate structures, it is enabled to "save" (to reduce) sizes and volume areas for mounting and use of the device in the domestic conditions of living or other rooms. Such size and volume of the space for mounting and disposing the assembled boiler may constitute, e.g., 400 mm for the depth, not more than 900 mm for the height, not more than 500 for the width (for the HWS container 1 of 50 liters).

The double-circuit electric boiler is mounted in coupled to two main lines, namely, to a main water supply line (or to a water well) and to the mains.

The HWS container 1 is coupled to the main water supply line by means of the inlet duct 11, while the WC container 2 is coupled by means of the inlet duct 9, which are independent between each other. The coupling to pipes of the system for supplying domestic hot water from the HWS container 1 is made by means of the outlet duct 10. In order to supply the heat-carrying agent to the room warming system, the WC container 2 is coupled to the warming system by means of the outlet duct 8, as well as (in case of the presence of the "pumping group") by means of the outlet pipe 22 of the warming circuit. Correspondingly, the outlet ducts 10 and 8 of the HWS container 1 and WC container 2 are independent from each other.

By means of the boiler control elements, e.g., by means of the control pane 26, the boiler is switched on. The HWS container 1 is filled with the water, the WC container 2 is also filled with the heat-carrying agent, e.g., water, and this heat-carrying agent being water fully enters to the system of the warming circuit, and the water from the HWS container 1 enters to the pipes of the circuit of the hot water supply system for domestic needs.

In the first embodiment of the boiler structure, by means of the at least one electric heater 3 of the heat-carrying agent of the warming circuit in the WC container 2, the water (heat-carrying agent) is successively heated, while it naturally (or by means of the "pumping group") enters the pipes and the heat-carrying elements of the room warming system. During heating of the heat-carrying agent in the WC container 2 by the electric heater 3 the inner walls 6 of the WC container 2 are also heated by the already heated heat-carrying agent (e.g., by the heated water). Therewith, the water in the HWS container 1 is in the direct contact with the outer surfaces of the heated inner walls 6 of the WC container 2 and, thus, naturally this water in the HWS container 1 is successively heated as well, and after a certain time this water may be used for domestic needs of the hot water supply without significant losses of the heat energy for the warming system. That is, the following heating chain occurs: the electric heater 3 heats the heat-carrying agent being water inside the WC container 2, the heat-carrying agent being water heats the inner walls 6 of the WC container 2, the outer surfaces of the inner walls 6 of the WC container 2 heat the water in the HWS container 1. The heat insulation layer 4 of the HWS container 1 additionally maintains the temperature of the walls of the HWS container 1 and, thus, maintains the temperature for the warm water that is constantly heated in the HWS container 1. After drain from the HWS container 1 and use of a certain amount of the hot water for domestic needs, a non-heated water from the water supply line again enters the HWS container 1 along the inlet duct 11 (under the action of the water supply line pressure, under the pressure of about 3 bars), and the process of heating this water from the outer surfaces of the inner walls 6 of the WC container 2 occurs again.

Of course, during heating of the water in the HWS container 1, additional heat losses occur in the WC container 2 Therewith, the controller 25 receives signals from the temperature sensor 13 for the water in the HWS container 1 and from the temperature sensor 12 of the heat-carrying agent in the WC container 2, and in order to maintain a certain required temperature in the WC container 2, due to an algorithm installed in the software controller 25, the controller 25 "controls" the heating of the electric heater 3 (increases or reduces a level of its heating) and, thus, the controller 25 also indirectly "controls" the temperature of the heat-carrying agent of the warming circuit inside the WC container 2 and the temperature of the inner walls 6 of the WC container 2 and then it controls increase or reduction of the heating of the water inside the HWS container 1 from the inner walls 6. That is, during operation of the boiler, the temperature of the heat-carrying agent inside the WC container 2 and temperature of the water in the HWS container 1 may be automatically regulated "in the course of time" (depending on needs of consumers and on the operation algorithm of the controller 25).

In cases, when the controller 25 is absent in the structure of the boiler, then, e.g., by means of a traditional stationary power regulator of the electric heater 3, the required power is set manually and, thus, a certain required temperature of the heat-carrying agent in the WC container 2 and in the warming circuit system is achieved. In such cases, the water in the HWS container 1 is heated from the inner walls 6 of the WC container 2 in a successive, slow and less controlled manner than "under the guidance" of the controller 25. The rate of such heating of the water in the HWS container 1 depends at least: on the power of the electric heater 3 and additional electric heaters 18 (if they are present in the structure); on the overall outer area of the inner walls 6 of the WC container 2; on the inner volume in the HWS container 1; on the initial temperature of the water that enters the HWS container 1; on the environmental temperature (where the boiler is disposed). Therefore, without the automatic regulation of the power of the electric heater 3 by the controller 25, the heating of the water in the HWS container 1 may last longer than when the automatic mode is present. However, if the electric heater 3 constantly heats the heat-carrying agent in the WC container 2, in this case, the heating of the water in the HWS container 1 is also occurs constantly from the inner walls 6 of the WC container 2, while after expense of the hot water from the WC container 2 for the domestic needs, the heating of a "new" cold water is initiated once it has entered the HWS container 1.

Therefore, due to the heating chain created in the first embodiment of the boiler structure, wherein the electric heater 3 heats the heat-carrying agent being water inside the WC container 2, and the heat-carrying agent being water heats the inner walls 6 of the WC container 2, and then the outer surfaces of the inner walls 6 of the WC container 2 effectively heat the water in the HWS container 1, it becomes possible to achieve a portion of the technical effect, namely to reduce the heat losses at least by 10% and, as a consequence, to increase the heat efficiency of the double-circuit electric boiler by at least 10%. The reduction of the "heat losses by at least 10% and increase of the heat efficiency by at least 10%" is meant in comparison with separate devices (for warming and for water heating and water supplying), which are mounted and operate autonomously in a single room, and each of them has heat losses separately from each other, or in comparison with the invention prototype, when the WC container is not disposed inside the HWS container and most of the area of the walls of the WC container is not in a contact with the water in the HWS container, rather is in a contact with the environment.

In the second embodiment of the boiler structure, by means of the at least one electric heater 3 of the heat-carrying agent of the warming circuit in the WC container 2, the water (heat-carrying agent) is successively heated, while it naturally (or by means of the "pumping group") enters the pipes and the heat-carrying elements of the room warming system. During heating of the heat-carrying agent in the WC container 2 by the electric heater 3 the inner walls 6 of the WC container 2 are also heated by the already heated heat-carrying agent (e.g., by the heated water). Therewith, the water in the HWS container 1 is in the direct contact with the outer surfaces of the heated inner walls 6 of the WC container 2 and, thus, naturally, this water in the HWS container 1 is also successively heated. Furthermore, the structure of the second embodiment of the boiler implies the presence of the electric heater 27 that is disposed in the HWS container 1 (in various design variants of the invention, the heater may be coupled to the controller 25 and to the control panel 26) and that further heats the water for the hot water supply circuit in the HWS container 1. That is, the heating of the water in the HWS container 1 is carried out simultaneously from the inner walls 6 of the WC container 2 and from the electric heater 27. After a certain time, this water from the HWS container 1 may be used for the domestic needs of the hot water supply without significant losses of the electric energy for the warming system. Furthermore, presence and operation of the electric heater 27 in the HWS container 1 enables: to heat the water for the domestic needs in the hot water supply circuit more rapidly; to reduce the heat expenses of the heat-carrying agent in the warming circuit; and to further mutually heat the inner walls 6 of the WC container 2, which, correspondingly, emit this heat to the heat-carrying agent of the warming circuit in the WC container 2. That is, during operation of the two electric heaters 3 and 27, there occurs a mutual heating and "heat balancing" of the liquid heat-carrying agents in the both WC and HWS containers. Therefore, during operation of the structure of the second embodiment of the boiler, the following two heating chains occurs therein. The first heating chain: the electric heater 3 heats the heat-carrying agent being water inside the WC container 2, the heat-carrying agent being water heats the inner walls 6 of the WC container 2, the outer surfaces of the inner walls 6 of the WC container 2 heat the water in the HWS container 1. The second heating chain: the electric heater 27 heats the heat-carrying agent being water inside the HWS container 1, this heated water partially transfers the heat energy to the outer surfaces of the inner walls 6 of the WC container 2, the inner surfaces of the inner walls 6 of the WC container 2 transfer the heat to the heat-carrying agent inside the WC container 2. Therefore, due to the mutual simultaneous heating of the heat-carrying agents, the system of two heat circuits elevates and "balances" the temperatures of two heat-carrying agents for the two independent circuits in a rather rapid and efficient manner. The heat insulation layer 4 of the HWS container 1 additionally maintains the temperature of the walls of the HWS container 1 and, thus, maintains the temperature for the hot water that is constantly heated in the HWS container 1. After drain from the HWS container 1 and use of a certain amount of the hot water for domestic needs, a non-heated water from the water supply line again enters the HWS container 1 along the inlet duct 11 (under the action of the water supply line pressure, under the pressure of about 3 bars), and the process of heating this water from the electric heater 27 and from the outer surfaces of the inner walls 6 of the WC container 2 occurs again.

Therefore, due to the two mutual heating chains created in the second embodiment of the structure of the boiler, it becomes possible to achieve a portion of the technical effect, namely, to reduce the heat losses by at least 10% and, as a consequence, to increase the heat efficiency of the double-circuit electric boiler by at least 10%. The reduction of the "heat losses by at least 10% and increase of the heat efficiency by at least 10%" is meant in comparison with separate devices (for warming and for water heating and water supplying), which are mounted and operate autonomously in a single room, and each of them has heat losses separately from each other, or in comparison with the invention prototype, when the WC container is not disposed inside the HWS container and most of the area of the walls of the WC container is not in a contact with the water in the HWS container, rather is in a contact with the environment.

Also, said structural solution of the second embodiment of the boiler (formation of two mutual heating chains) further enables to significantly increase the heating rate of the hot water in the hot water supply circuit for the domestic use as compared to separate devices for warming and for water heating and water supply, which are mounted and operate autonomously in a single room, do not have a physical contact between the walls of the containers and the heat-carrying agents, and, thus, are not able to "transfer" the heat energy mutually in order to speed up the heating of the heat-carrying agents.

The presence of the electric heater 27 in the second embodiment of the boiler structure also enables to use the boiler for maintaining the temperature of the heat-carrying agent in the warming circuit in case of a failure, replacement or repair of the electric heater 3 in the WC container 2. That is, if the electric heater 3 in the WC container 2 does not operate in case of certain circumstances or it is temporarily absent, then the operation of the electric heater 27 in the HWS container 1 and heating of the heat-carrying agent in the WC container 2 from the hot water in the HWS container 1 through the inner walls 6 of the WC container 2 enables to maintain the temperature in the entire warming circuit. Of course, such temperature may be lower than the one during operation of the electric heater 3 and, thus, in such cases, it is desirable to reduce the expenses of the hot water from the HWS container 1 for the domestic needs, however, the operation of the electric heater 27 in the HWS container 1 in such situations will enable to maintain the presence of the heat-carrying agent and a certain temperature in the room warming circuit prior to start of the operation of the electric heater 3 in the WC container 2 that is a rather considerable achievement upon implementation of this embodiment of the invention. Therefore, due to the presence and independence of the operation of the two electric heaters 3 and 27 in the second embodiment of the boiler structure and due to the two mutual heating chains formed in the second embodiment of the invention, it becomes possible to achieve a portion of the technical effect, namely, to enable the mutual heating of the heat-carrying agents in the containers of the two circuits between each other in case when the electric heaters does not operate in one of the circuits, and, as a consequence, to achieve a more stable overall operation of the double-circuit electric boiler, i.e., to increase the stability of heating of the hot water in both circuits, and, as a consequence, to achieve the increase of the stability of supplying the heat-carrying agent to the warming system and increase of the stability of supplying the hot water for the domestic use.

The second embodiment of the boiler structure is intended to operate in the mode, when both electric heaters 3 (WC) and 27 (of the HWS circuit) operate. In this mode, the electric heater 3 "aims" to heat the heat-carrying agent of the warming circuit to a value set by the consumer. It should be noted that the boiler control panel 26, in particular, the controller 25 (of both first and second embodiments), may be coupled to an external temperature sensor in the room, where the boiler is used. Depending on the temperature of the heat-carrying agent that is established (set) on the control panel 26, and depending on the readings of the external temperature sensor that is controlled by the consumer in a separate and independent manner—sets the required temperature in the room, and that is coupled to the controller 25 (the external temperature sensor is meant), as well as depending on the real temperature readings of the reverse (input) and output heat-carrying agent of the HC, a next heating level of the electric heater 3 is turned on or off in order to provide softness and neutralizing a load on the mains. This operation of the electric heater 3 does not depend on the amount of a "takeoff" (rate) of the hot water from the HWS container 1, however, the operation of the electric heater 3 depends on the overall temperature of the water in the HWS container—the lower this temperature is, the higher is the load and the heating of the electric heater 3, and vice versa. The structure of the second embodiment of the boiler during its operation implies achievement of the maximum temperature in the warming circuit of up to 60° C., and in the hot water supply circuit of up to 60° C. In order to optimize the costs for the electric energy and to provide a safe use of the device, the structure and the operation process of the second embodiment of the boiler are based on the following concept: Upon achievement of the temperature value of 60° C. in the HWS container 1, i.e. if within a long time (several hours) there is no drain (distribution) of the hot water (e.g., at night), the maximum temperature in the warming circuit reaches the value of 60° C. Therewith, the electric heater 27 in the HWS container 1 turns on for the operation (for heating) under the following condition:

- the temperature inside the HWS container 1 is lower than the one given within the range of from 20° C. to 40° C., and the electric heater 27 turns off when the temperature is greater than 40° C. (the water in the HWS container 1 is "heated up" to the greater temperature by: the electric heater 3—the heat-carrying agent in the WC container 2, the outer walls 6 of the WC container 2);
- the electric heater 27 in the HWS container 1 is turned off within a given daily time range, e.g., from 11 p.m. till 6 a.m. (as desired by the consumer), only the electric heater 3 in the WC container 2 operates, which walls 6 heat the water in the HWS container 1 during this long time.

The processes of turning on/off the electric heater 27 of the HWS container 1 as well as the electric heater 3 of the WC container 2 are automatically controlled by the programmed controller 25 or manually by the consumer.

Therefore, during operation of the second embodiment of the boiler, the heat-carrying agent in the warming circuit and the water in the hot water supply circuit is capable of being heated independently by the own electric heater. For example, this allows to use only the heating of the water in the HWS container 1 in the summer time with the electric heater 3 in the WC container 2 turned off. Also, when there is no need in the domestic hot water, the electric heater 3 in the WC container 2 operates independently and without use of the electric heater 27 in the HWS container 1 (e.g., when there is no people in the room for a long time and it is necessary to maintain only a minimum temperature in the warming circuit). Thus, in such use cases of the second embodiment of the structure of the boiler, it is enabled:

- to reduce the % of electric energy costs for heating the liquids in the warming circuit and in the hot water supply circuit;
- to achieve a possibility of the mutual heating of the heat-carrying agents in the containers of the both circuits between each other in case if the electric heater does not operate in one of the circuits and, as a consequence, to achieve a more stable overall operation of the double-circuit electric boiler.

Operation of the Additional Structural Elements of the Boiler.

In order to enhance the efficiency of the mutual heat exchange between the inner walls 6 of the WC container 2 and the water inside the HWS container 1, in both embodiments of the invention, the outer surfaces of the inner walls 6 of the WC container 2 may be provided with the heat exchange ribs 14, which significantly increase the outer heat exchange area of the surface of the WC container 2 and allow to increase the speed and efficiency of the mutual heat exchange between the inner walls 6 of the WC container 2 and the water inside the HWS container 1, thereby facilitating the achievement of the technical effect in terms of:

- increase of the heat efficiency of the double-circuit electric boiler;
- achievement of the mutual heating of the heat-carrying agents in the containers of both circuits between each other, if the electric heater does not operate in one of the circuits, increase of the heating stability of the hot water in both circuits, and increase of stability of supplying the heat-carrying agent to the warming system and increase of stability of supplying the hot water for the domestic use.

In both embodiments of the double-circuit electric boiler, the electric heater 3 for the heat-carrying agent of the warming circuit may be inserted and secured in the WC container 2 by means of the flange 15 (that is simultaneously is the outer wall 7 of the WC container 2) or by means of the additional flange 17 that is, in turn, mounted and sealably secured in the corresponding technological opening on the outer wall 7 of the container 2 of the heat-carrying agent of the warming circuit. Also, the electric heater 3 for the heat-carrying agent of the warming circuit may be inserted and secured in the WC container 2 by means of the additional flange 17 that is, in turn, mounted and sealably secured in the corresponding technological opening of the outer wall 7 that is made in the form of the flange 15 that is a bottom of the container 2 for the heat-carrying agent of the warming circuit. That is, the electric heater 3 may be fixed to the outer wall 7, which is shown in FIGS. 1-12 of the invention as the lower wall flange 15, and functionally is the outer wall 7 of the WC container 2. Attention should be paid to the fact that said FIGS. 1-12 show the attachment of the electric heater 3 exclusively through the additional flange 17, while attachment of "a direction" to the outer wall 7 (to the flange 15) is not shown, however, in practice such attachment may be used. As it has been mentioned, the electric heater 3 may be attached to the additional flange 17 (FIG. 1-12) that may be attached to one of the walls of the HWS container 1 (e.g., to the mounting wall 16 of the HWS container 1) without using the flange 15 (not shown in Figures) or "through" the flange 15 (FIG. 1-12) depending on the boiler structure in various separate cases.

The additional electric heaters 18 of the heat-carrying agent of the warming circuit also may be mounted and sealably secured in the corresponding technological opening of the outer wall 7 of the WC container 2 (also the additional electric heaters 18 may be attached to the flange 18 as well, if it represents the outer wall 7 of the WC container 2) or to the additional flange 17.

Use of the flange 15 and/or the additional flange 17 for attachment of the electric heater 3 (or several additional heaters 18 as well) in the WC container 2 allows to:

- increase the reliability and density of attachment of the electric heater 3 in the WC container 2;
- carry out rapid and convenient mounting/dismounting of the electric heater 3 (or several electric additional heaters 18 as well) from the WC container 2 (and from the entire boiler structure) in order to perform replacement, maintenance or repair of the electric heater 3 (or several additional electric heaters 18 as well).

The temperature sensor 12 for the heat-carrying agent in the WC container 2 also may be mounted and sealably attached to the additional flange 17 that also enables to carry out rapid and convenient mounting/dismounting of the temperature sensor 12 for the heat-carrying agent in the WC container 2 from the WC container 2 (and from the entire boiler structure) in order to perform replacement, maintenance or repair of the temperature sensor 12 for the heat-carrying agent in the WC container 2.

Use of various variants of mounting and securing of the electric heater 3, additional electric heaters 18 and temperature sensor 12 in the WC container 2 that is, in turn, mounted and secured in the HWS container 1, enables to improve the achievement of the technical effect in terms of achievement of a possibility of combining two devices (the warming one and the water heating and water supply one) into a single device and, in view of this, optimization and reduction of sizes and dimensions of the overall structure and reduction of a place for mounting and usage of the device in the domestic conditions.

In the second design and operation variant of the boiler, the at least one electric heater 27 for the water in the HWS container 1 and the temperature sensor 13 in the HWS container 1 may be mounted and attached to the flange 28 that is, in turn, mounted and sealably secured in the corresponding technological opening of one of the outer walls of the HWS container 1, e.g., in the mounting wall 16. Such a structural solution allows to carry out rapid and convenient mounting/dismounting of the electric heater 27 and the temperature sensor 13 from the WC container 2 (and from the entire boiler structure) in order to perform replacement, maintenance or repair of these temperature sensors 13 and the electric heater 27.

As it has been already mentioned, in separate design variants of both embodiments of the invention, the double-circuit electric boiler may be equipped with the "pumping group", wherein the pump 20 "pumps" and forcefully supplies the heat-carrying agent from the WC container 2 to the pipeline of the room warming system. That is, the pump 20 is intended to provide an estimated flow of the liquid heat-carrying agent of the warming circuit through the WC container 2. The pump 20 may be controlled by the controller 25. At the "output" of the WC container 2, at the outlet pipe 22 of the warming circuit, prior to the pump 20, there is mounted the flow control sensor 19 for the liquid heat-carrying agent of the warming circuit that is intended to fix the boundary values of the flow of the liquid heat-carrying agent through the WC container 2. The flow control sensor 19 for the liquid transmits signals to the controller 25. After the pump 20, at the outlet pipe 22 of the warming circuit the safety valve 21 of the warming circuit is mounted, and the expansion tank 23 is attached to the outlet pipe 22 of the warming circuit, which are intended to provide overall operational safety of the warming circuit system. The ability of manual coupling of the "pumping group" to both embodiments of the proposed boiler enables to improve the overall usage of the device, as well as to improve and to enhance the achievement of the technical effects for both embodiments of the boiler.

The control elements of both embodiments of the boiler may be made in the form of an electronic system that may be based on use of the controller 25. All the required electric details of the boiler are coupled to this electronic system. Sensor or mechanical or other electric systems for controlling the boiler may be arranged on the control panel 26 that enables consumers to turn on, turn off, set and monitor the operation of the boiler. Convenient control elements for the boiler represent the required attribute in structures of modern warming and water heating and water supply devices, thus, presence and operation of elements, which are represented in the form of the electronic system that may be based on use of the controller 25 and which are arranged on the control panel 26, improve and enhance the achievement of the technical effects during operation of each of the proposed embodiments of the boiler.

INDUSTRIAL APPLICABILITY

The proposed double-circuit electric boiler has passed broad studies in the course of its experimental manufacture, as well as in the process of its usage in various rooms for warming these rooms and for heating the hot water for domestic needs.

Results of the studies has shown that the structure of the proposed invention allows to create at least two embodiments of the double-circuit electric boiler, each of them, during its usage, due to the set of all essential features, allows to achieve the technical effect during the simultaneous heating of the heat-carrying agent for the warming system and heating of the hot water for the domestic water supply.

Examples of a specific industrial implementation of the proposed embodiments of the invention, their use are mentioned above as the best exemplary implementations.

The proposed double-circuit electric boiler meets all the requirements of its usage, utilizing and all commonly accepted safety rules for usage of such devices for warming rooms and for boiling the hot water for domestic needs.

What is claimed is:

1. A double-circuit electric boiler, comprising: a power supply system, control elements, a housing (5) having inside a container (1) for a water of a hot water supply circuit and a container (2) for a heat-carrying agent of a warming circuit, wherein at least one electric heater (3) of the heat-carrying agent of the warming circuit is mounted inside the container (2), and each of said two containers (1), (2) comprises an inlet (9,11) and an outlet ducts (8,10), and the container (1) for the water of the hot water supply circuit comprises a heat insulation layer (4), characterized in that the container (2) for the heat-carrying agent of the warming circuit, along with the at least one electric heater (3) of the heat-carrying agent of the warming circuit mounted in the container (2), is mounted and sealably and rigidly secured inside the container (1) for the water of the hot water supply circuit such that one of surfaces of the container (2) for the heat-carrying agent of the warming circuit is an outer wall (7) that is disposed and secured outside the container (1) for the water of the hot water supply circuit such that an inner surface (29) of the outer wall (7) is in a contact with a mounting wall (16) of the container (1) of the hot water supply circuit, and an outer surface (30) of the outer wall (7) is disposed outside the container (1) of the hot water supply circuit, wherein the outer surfaces of inner walls (6) of the container (2) of the heat-carrying agent of the warming circuit that is disposed inside the container (1) for the water of the hot water supply circuit are in contact with the water of the hot water supply circuit inside the container (1) for the water of the hot water supply circuit, furthermore, the at least one electric heater (3) for the heat-carrying agent of the warming circuit is fully isolated by the inner walls (6) of the container (2) of the warming circuit from a contact with the water of the hot water supply circuit that is disposed inside the container (1) of the hot water supply circuit, wherein the outlet duct (8) for drain of the heat-carrying agent from the container (2) of the warming circuit and the inlet duct (9) for supplying the heat-carrying agent into the container (2) of the warming circuit are sealably mounted and secured in technological openings of the outer wall (7) of the container (2) of the warming circuit, and their end openings are sealably coupled to the corresponding technological openings of the container (2) of the warming circuit inside the container (1) of the hot water supply circuit, and an outlet duct (10) for drain of the water from the container (1) of the hot water supply circuit and an inlet duct (11) for supplying the water into the container (1) of the hot water supply circuit are sealably mounted and secured in the corresponding technological openings of one of the walls of the container (1) of the hot water supply circuit such that their end openings are disposed inside the container (1) of the hot water supply circuit and areas of these outlet (10) and inlet (11) ducts, which are disposed inside the container (1) for the water of the hot water supply circuit, are fully isolated by the inner walls (6) of the container (2) of the heat-carrying agent of the warming circuit from a contact with the heat-carrying agent in the container (2) of the warming circuit, furthermore, inside the container (2) of the warming circuit, there is mounted a temperature sensor (12) for the heat-carrying agent in the container (2) of the warming circuit such that this temperature sensor (12) is fully isolated by the inner walls (6) of the container (2) from a contact with the water in the container (1) of the hot water supply circuit, and inside the container (1) of the hot water supply circuit, there is mounted a temperature sensor (13) for the water in the container (1) such that this temperature sensor (13) is fully isolated by the inner walls (6) of the container (2) from a contact with the heat-carrying agent in the container (2) of the warming circuit.

2. A double-circuit electric boiler, comprising: a power supply system, control elements, a housing (5) having inside a container (1) for a water of a hot water supply circuit, the container (1) having inside at least one electric heater (27) for the water of the hot water supply circuit, and a container (2) for a heat-carrying agent of a warming circuit, wherein at least one electric heater (3) of the heat-carrying agent of the warming circuit is mounted inside the container (2), and each of said two containers (1), (2) comprises an inlet and an outlet ducts (9,11 and 8,10), and the container (1) for the water of the hot water supply circuit comprises a heat insulation layer (4), characterized in that the container (2) for the heat-carrying agent of the warming circuit, along with the at least one electric heater (3) of the heat-carrying agent of the warming circuit mounted in the container, is mounted and sealably and rigidly secured inside the container (1) for the water of the hot water supply circuit such that one of surfaces of the container (2) for the heat-carrying agent of the warming circuit is an outer wall (7) that is disposed and secured outside the container (1) for the water of the hot water supply circuit such that an inner surface (29) of the outer wall (7) is in a contact with a mounting wall (16) of the container (1) of the hot water supply circuit, and an outer surface (30) of the outer wall (7) is disposed outside the container (1) of the hot water supply circuit, wherein the outer surfaces of inner walls (6) of the container (2) of the heat-carrying agent of the warming circuit that is disposed inside the container (1) for the water of the hot water supply circuit are in a contact with the water of the hot water supply circuit inside the container (1) for the water of the hot water supply circuit, furthermore, the at least one electric heater (3) of the heat-carrying agent of the warming circuit is fully isolated by the inner walls (6) of the container (2) of the warming circuit from a contact with the water of the hot water supply circuit that is disposed inside the container (1) of the hot water supply circuit, wherein the outlet duct (8) for drain of the heat-carrying agent from the container (2) of the warming circuit and the inlet duct (9) for supplying the heat-carrying agent into the container (2) of the warming circuit are sealably mounted and secured in technological openings of the outer wall (7) of the container (2) of the warming circuit, and their end openings are sealably coupled to the corresponding technological openings of the container (2) of the warming circuit inside the container (1) of the hot water supply circuit, and an outlet duct (10) for drain of the water from the container (1) of the hot water supply circuit and an inlet duct (11) for supplying the water into the container (1) of the hot water supply circuit are sealably mounted and secured in the corresponding technological openings of one of the walls of the container (1) of the hot water supply circuit such that their end openings are disposed inside the container (1) of the hot water supply circuit and areas of these outlet (10) and inlet (11) ducts, which are disposed inside the container (1) for the water of the hot water supply circuit, are fully isolated by the inner walls (6)

of the container (2) of the heat-carrying agent of the warming circuit from a contact with the heat-carrying agent in the container (2) of the warming circuit, furthermore, inside the container (2) of the warming circuit, there is mounted a temperature sensor (12) for the heat-carrying agent in the container (2) of the warming circuit such that this temperature sensor (12) is fully isolated by the inner walls (6) of the container (2) from a contact with the water in the container (1) of the hot water supply circuit, and inside the container (1) of the hot water supply circuit, there is mounted a temperature sensor (13) for the water in the container (1) such that this temperature sensor (13) is fully isolated by the inner walls (6) of the container (2) for the heat-carrying agent of the warming circuit from a contact with the heat-carrying agent in the container (2) of the warming circuit, furthermore, the at least one electric heater (27) for the water of the hot water supply circuit is mounted and sealably secured in the corresponding technological opening of one of the walls of the container (1) for the water of the hot water supply circuit in such a way that heating sections of the electric heater (27) are disposed inside the container (1) of the hot water supply circuit and are fully isolated by the inner walls (6) of the container (2) for the heat-carrying agent of the warming circuit from a contact with the heat-carrying agent in the container (2) of the warming circuit.

3. The double-circuit electric boiler according to claim 1 or claim 2, characterized in that heat exchange ribs (14) are disposed on outer surfaces of the inner walls (6) of the container (2) of the heat-carrying agent of the warming circuit.

4. The double-circuit electric boiler according to claim 1, characterized in that the outer wall (7) of the container (2) for the heat-carrying agent of the warming circuit is made in the form of a flange (15) that is a bottom of the container (2) for the heat-carrying agent of the warming circuit and that is connected to the inner walls (6) in the lower portion of the container (2) for the heat-carrying agent of the warming circuit, wherein the outer wall (7) in a form of the flange (15) is configured to be sealably secured to one of the walls of the container (1) of the hot water supply circuit.

5. The double-circuit electric boiler according to claim 1, characterized in that the at least one electric heater (3) for the water-carrying agent of the warming circuit is mounted and fixed to an additional flange (17) that is, in turn, mounted and sealably secured in a corresponding technological opening of the outer wall (7) of the container (2) of the warming circuit or the electric heater (3) of the heat-carrying agent of the warming circuit is mounted and sealably secured in the corresponding technological opening of the outer wall (7) that is made in the form of the flange (15) that is a bottom of the container (2) for the heat-carrying agent of the warming circuit.

6. The double-circuit electric boiler according to claim 1, characterized in that the boiler comprises at least one additional electric heater (18) of the heat-carrying agent of the warming circuit that is mounted and sealably secured in the corresponding technological opening of the outer wall (7) of the container (2) for the heat-carrying agent of the warming circuit or is mounted and secured to the additional flange (17) that is, in turn, mounted and sealably secured in the corresponding technological opening of the outer wall (7) of the container (2) for the heat-carrying agent of the warming circuit or in the technological opening of the outer wall (7) that is made in the form of flange (15) that is the bottom of the container (2) for the heat-carrying agent of the warming circuit.

7. The double-circuit electric boiler according to claim 5, characterized in that the temperature sensor (12) for the heat-carrying agent in the container (2) of the warming circuit is mounted and sealably secured to the additional flange (17).

8. The double-circuit electric boiler according to claim 1, characterized in that it further comprises a flow monitoring sensor (19) for the heat-carrying agent of the warming circuit, a pump (20) of the warming circuit and a safety valve (21) of the warming circuit, which are mounted on an outlet pipe (22) of the warming circuit that is, in turn, coupled to the outlet duct (8) for drain of the heat-carrying agent from the container (2) of the warming circuit.

9. The double-circuit electric boiler according to claim 8, characterized in that an expansion tank (23) is connected to the outlet pipe (22) of the warming circuit.

10. The double-circuit electric boiler according to claim 1, characterized in that the boiler control elements are made in a form of an electronic system that comprises a controller (25), and this electronic system is assembled on a control panel (26) that is secured on a wall of the boiler housing (5), and a power supply and also the at least one electric heater (3) for the heat-carrying agent of the warming circuit, the temperature sensor (12) for the heat-carrying agent of the warming circuit, and the temperature sensor (13) for the water in the container (1) of the hot water supply circuit are coupled to the control panel (26).

11. The double-circuit electric boiler according to claim 8, characterized in that the boiler control elements are made in a form of an electronic system that comprises a controller (25), and this electronic system is assembled on a control panel (26) that is secured on a wall of the boiler housing (5), and a power supply and also the at least one electric heater (3) for the heat-carrying agent of the warming circuit, the temperature sensor (12) for the heat-carrying agent of the warming circuit, the temperature sensor (13) for the water in the container (1) of the hot water supply circuit, the flow control sensor (19) for the liquid heat-carrying agent of the warming circuit and the warming circuit pump (20) are coupled to the control panel (26).

12. The double-circuit electric boiler according to claim 6, characterized in that the boiler control elements are made in a form of an electronic system that comprises a controller (25), and this electronic system is assembled on a control panel (26) that is secured on a wall of the boiler housing (5), and a power supply and also the at least one electric heater (3) and the at least one additional electric heater (18) of the warming circuit for the heat-carrying agent of the warming circuit, the temperature sensor (12) for the heat-carrying agent of the warming circuit, the temperature sensor (13) for the water in the container (1) of the hot water supply circuit are coupled to the control panel (26).

13. The double-circuit electric boiler according to claim 8, characterized in that the boiler control elements are made in a form of an electronic system that comprises a controller (25), and this electronic system is assembled on a control panel (26) that is secured on a wall of the boiler housing (5), and a power supply and also the at least one electric heater (3) and at least one additional electric heater (18) of the warming circuit for the heat-carrying agent of the warming circuit, the temperature sensor (12) for the heat-carrying agent of the warming circuit, the temperature sensor (13) for the water in the container (1) of the hot water supply circuit, the flow control sensor (19) for the liquid heat-carrying agent of the warming circuit and the warming circuit pump (20) are coupled to the control panel (26).

14. The double-circuit electric boiler according to claim 2, characterized in that the at least one electric heater (27) for the water in the container (1) of the hot water supply circuit is mounted and secured to a flange (28) that is, in turn, mounted and sealably secured in the corresponding technological opening of one of the outer walls of the container (1) of the hot water supply circuit.

15. The double-circuit electric boiler according to claim 14, characterized in that the temperature sensor (13) for the water in the container (1) of the hot water supply circuit is mounted and secured to the flange (28) of the electric heater (27) for the water in the container (1) of the hot water supply circuit.

16. The double-circuit electric boiler according to claim 10 or claim 11 or claim 12 or claim 13 or claim 15, characterized in that the at least one electric heater (27) for the water in the container (1) of the hot water supply circuit is coupled to the control panel (26).

* * * * *